US008800811B2

(12) United States Patent
Sherretts et al.

(10) Patent No.: US 8,800,811 B2
(45) Date of Patent: Aug. 12, 2014

(54) PRODUCT DISPENSING SYSTEM

(75) Inventors: Jeffrey Sherretts, North Babylon, NY (US); George J. Ruggeri, Hicksville, NY (US)

(73) Assignee: Southern Imperial, Inc., Rockford, IL (US)

( * ) Notice: Subject to any disclaimer, the term of this patent is extended or adjusted under 35 U.S.C. 154(b) by 671 days.

(21) Appl. No.: 13/042,270

(22) Filed: Mar. 7, 2011

(65) Prior Publication Data

US 2011/0220597 A1 Sep. 15, 2011

Related U.S. Application Data

(60) Provisional application No. 61/312,404, filed on Mar. 10, 2010.

(51) Int. Cl.
*G07F 11/00* (2006.01)

(52) U.S. Cl.
USPC ..... 221/154; 221/126; 221/283

(58) Field of Classification Search
USPC ..... 221/126, 154, 155, 283, 134, 93, 123
See application file for complete search history.

(56) References Cited

U.S. PATENT DOCUMENTS

| | | | | |
|---|---|---|---|---|
| 4,108,515 | A * | 8/1978 | Johnson | 312/119 |
| 4,336,892 | A * | 6/1982 | Cox et al. | 221/125 |
| 5,450,969 | A | 9/1995 | Johnson et al. | |
| 5,553,736 | A * | 9/1996 | Healis | 221/62 |
| 5,992,652 | A | 11/1999 | Springs | |
| 7,007,820 | B1 * | 3/2006 | Cumer | 221/75 |
| 7,389,886 | B2 | 6/2008 | Hardy et al. | |
| 7,533,784 | B2 | 5/2009 | Vlastakis et al. | |
| 7,641,072 | B1 | 1/2010 | Vlastakis et al. | |
| 7,828,158 | B2 * | 11/2010 | Colelli et al. | 211/59.3 |
| 2005/0218094 | A1 | 10/2005 | Howerton et al. | |
| 2009/0184130 | A1 | 7/2009 | Miller et al. | |
| 2009/0242582 | A1 * | 10/2009 | Vlastakis et al. | 221/123 |

FOREIGN PATENT DOCUMENTS

JP 2007-148581 A 6/2007

* cited by examiner

*Primary Examiner* — Timothy Waggoner
(74) *Attorney, Agent, or Firm* — Reinhart Boerner Van Deuren P.C.

(57) ABSTRACT

A product dispensing system is provided. The product dispensing system includes an enclosure and a plurality of removable merchandise retainers positioned within the enclosure. The enclosure defines a secured retail storage area and an unsecured retail storage area. The product dispensing system also includes a customer accessible selector for selecting an item of retail merchandise carried by one of the merchandise retainers. Upon selection, depression of an actuator of the selector will bias the item of retail merchandise from the secured retail storage area to the unsecured retail storage area.

14 Claims, 20 Drawing Sheets

PRODUCT DISPENSING SYSTEM

CROSS-REFERENCE TO RELATED PATENT APPLICATIONS

This patent application claims the benefit of U.S. Provisional Patent Application No. 61/312,404, filed Mar. 10, 2010, the entire teachings and disclosure of which are incorporated herein by reference thereto.

FIELD OF THE INVENTION

The present disclosure relates to merchandising and, more particularly, to a modular product dispensing system capable of selectively dispensing a specific product selected by a user.

BACKGROUND OF THE INVENTION

Smaller retail products typically found on shelves or hanging from hooks are susceptible to theft in large quantities. These smaller products are quickly and easily swept into bags or coat pockets and can then be carried out of the store by shoplifters. Relatively expensive or high demand items, such as over-the-counter medications, razor blades, batteries, DVD's, and the like may be particularly susceptible to theft in large quantities.

In order to combat theft in large quantities, or "sweeping," retail stores have attempted to monitor activity within the store through the use of video cameras and/or increased security. However, security systems are a significant investment and require an employee to monitor the systems in search of suspicious activity. Hiring a security guard is also expensive and may not fully combat theft problems, especially in larger stores.

As a result, some retail stores have begun locking expensive and/or high demand items in display cases or placing the items behind the counter. While making products inaccessible to the customer without the assistance of a store employee may reduce the incidents of theft, it has been found that sales decrease significantly when products are no longer accessible to the customer. Additionally, placing products in locked display cases and/or behind the counter requires a store employee to assist customers in retrieving the inaccessible items.

Therefore, it would be advantageous to provide a customer-accessible product dispensing system that helps prevent theft in large quantities without the need for additional security and/or assistance by an employee.

The invention provides such a customer-accessible product dispensing system. These and other advantages of the invention, as well as additional inventive features, will be apparent from the description of the invention provided herein.

BRIEF SUMMARY OF THE INVENTION

As will be understood from the following, aspects of the various embodiments of the invention provide a retail display for securely carrying retail merchandise that advantageously deters or prevent retail theft while simultaneously removing the need for a customer to locate an employee to obtain merchandise carried by the retail display. A retail display according to one embodiment of the invention includes a retail support wall adapted for carrying retail merchandise thereon. A housing is mounted to the retail support wall. The housing defines a secure retail storage area. At least one merchandise retainer is also mounted within the secure retail storage area for carrying retail merchandise thereon. The merchandise retainer includes a biasing mechanism for biasing retail merchandise forward. The retail display also includes a selector coupled to the housing. Depression of an actuator of the selector causes the biasing mechanism of the at least one merchandise retainer to bias an item of retail merchandise forward to transition the item of retail merchandise from a secured storage area to an unsecured storage area to allow customer access to the item of retail merchandise.

In certain embodiments, the housing includes at least one slidable door. A merchandise channel is formed between the at least one slidable door and the at least one merchandise retainer. The merchandise channel is arranged to permit communication between the secure storage area and the unsecured storage area. In certain embodiments, the at least one slidable door includes a lock for fixing the position of the at least one slidable door relative to the remainder of the housing such that access to the retail merchandise carried by the housing is restricted to the unsecured storage area.

In certain embodiments, the at least one merchandise channel communicates with a catch tray. The catch tray defines the unsecured storage area. The catch tray is positioned below the at least one merchandise retainer. In certain embodiments, the catch tray is rotatable between an open position and a closed position such that access to the unsecured storage area is allowed in the open position and prevented in the closed position. In certain embodiments, the catch tray includes a shield. The shield is positioned adjacent to an opening of the catch tray such that retail merchandise is prevented from entry into the unsecured storage area when the catch tray is in the open position.

In certain embodiments, the shield is positioned relative to the at least one merchandise retainer such that retail merchandise is biased off of the shield by the at least one merchandise retainer as the catch tray transitions from the open position to the closed position.

In certain embodiments, the at least one merchandise retainer includes a plurality of merchandise retainers. The selector is slidable along a track of the housing. The selector is selectively alignable with each one of the plurality of merchandise retainers. In certain embodiments, the actuator of the selector is magnetic. The biasing mechanism of each of the plurality of merchandise retainers includes a lock for preventing actuation of the biasing mechanism. Depression of the actuator magnetically unlocks the lock to allow actuation of the biasing mechanism.

In another embodiment, a retail display for retail merchandise in a display unit is provided. A retail display according to this embodiment includes a security enclosure for securing retail merchandise therein. The enclosure has an outlet area arranged to facilitate customer access to merchandise. The retail display also includes a retail mount adapted to mount the security enclosure to a retail display unit. A merchandise retainer is contained in the security enclosure. The merchandise retainer is adapted to retain retail merchandise in the security enclosure and above the outlet area. A drive is operable to release retail merchandise from the merchandise retainer to the outlet area. A selector is mounted along the security enclosure. The selector is operable to actuate the drive to release retail merchandise.

In certain embodiments, the security enclosure includes a plurality of mounting brackets adapted for receiving the merchandise retainer. In certain embodiments, the merchandise retainer includes a first and a second plurality of merchandise retainers. The first plurality is arranged in a row and the second plurality is arranged in a row below the first plurality. The first plurality of merchandise retainers is mounted between a first pair of mounting brackets of the plurality of mounting brackets. The second plurality of merchandise retainers is mounted on top of a second pair of mounting brackets of the plurality of mounting brackets.

In certain embodiments, each one of the first plurality of merchandise retainers includes a front and a rear engagement rib. Each one of the first pair of mounting brackets includes a groove for receiving the front and rear engagement ribs, respectively. In certain embodiments, one of the first pair of mounting brackets includes a resilient member for biasing the first plurality of merchandise retainers into engagement with the other one of pair of mounting brackets.

In certain embodiments, each one of the second plurality of merchandise retainers includes a retaining member formed on a bottom thereof for affixing the second plurality of merchandise retainers to the second pair of mounting brackets in a fixed position. In another embodiment, a retail merchandise pusher is provided. A retail merchandise pusher according to this embodiment includes a housing extending between a front and a rear edge. The housing defines a track. A pusher body is slidably received on the track and slidable between the front and rear edges of the housing. The retail merchandise pusher also includes a drive assembly mounted to the housing. The drive assembly includes a cable and a biasing element. An end of the cable is affixed to the pusher body. The cable is unwound from the drive assembly when the pusher body is moved toward the rear edge. The biasing element biases the cable in a winding direction to wind up the cable and move the pusher body toward the front edge along the track.

In certain embodiments, the pusher includes at least one engagement rib extending from one of the front and rear edges of the track. The at least one engagement rib is adapted to secure the pusher to a mounting bracket. In certain embodiments, the pusher can also include an alignment rib formed on an exterior of the housing. The alignment rib is adapted to align the pusher body within a retail enclosure. In certain embodiments, the pusher further comprises a retail merchandise hook. The hook includes a backing plate mounted to the housing. An elongated section of the hook extends from the backing plate through a slot of the housing. The elongated section extends through the pusher body.

In certain embodiments, the track is removable from the housing and includes a pair of channels. In certain embodiments, a first channel of the pair of channels receives a portion of the cable unwound from the drive assembly and receives a cable receiver of the pusher body. The end of the cable is affixed to the cable receiver. The cable receiver is slidable within the first channel.

In certain embodiments, the pusher further comprises a pusher guide at the bottom of the pusher body. The pusher guide includes a plurality of guide ribs. At least one of the plurality of guide ribs is received in a second channel of the pair of channels. The at least one guide rib is slidable within the second channel. In certain embodiments, at least one other one of the plurality of guide ribs is slidable along a guide rail of the housing. In certain embodiments, the pusher guide is removable.

In yet another embodiment, a method for dispensing retail merchandise from a secured retail merchandise display is provided. A method according to this embodiment includes carrying retail merchandise in a housing having a secured and an unsecured area. Sliding an actuator coupled to the housing into alignment with the merchandise. The method further includes depressing the actuator and transitioning an item of the retail merchandise from the secured area to the unsecured area upon depression of the actor. In certain embodiments, transitioning the item of retail merchandise includes biasing the item of retail merchandise off of a merchandise retainer and into a catch tray defining the unsecured area. In certain embodiments, the method further comprises rotating the catch tray to an open position from a closed position after the item of retail merchandise has transitioned from the secured area to the unsecured area. In certain embodiments, the method further comprises loading retail merchandise into the housing through a slidable door providing access to the secured merchandise area.

In yet another embodiment, a product dispensing system is provided. A product dispensing system according to this embodiment includes a display housing having a slot extending along a bottom side thereof. At least one product retaining rack is releasably disposed within the display housing. Each product retaining rack is configured for releasably retaining a plurality of products longitudinally therealong. Each product retaining rack includes a pusher. The pusher is engaged within a track defined along the product retaining rack and longitudinally translatable along the product retaining rack to translate the products with respect to the product retaining rack. Each product retaining rack also includes a selectively actuatable drive assembly coupled to the pusher such that when activated, the drive assembly effects longitudinal translation of the pusher with respect to the product retaining rack in a forward direction, thereby translating the plurality of products in a forward direction. Each product retaining rack is also in communication with an actuator positioned on the display housing. The actuator is selectively positionable adjacent the at least one product retaining rack. The actuator is depressable from an unactuated position to an actuated position. The drive assembly is activated to effect longitudinal translation of the pusher with respect to the product retaining rack when the actuator is in the actuated position. When the products are translated forward with respect to the product retaining rack a predetermined distance, one of the products disengages the product retaining rack and exits the display housing through the slot defined therein.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1A:
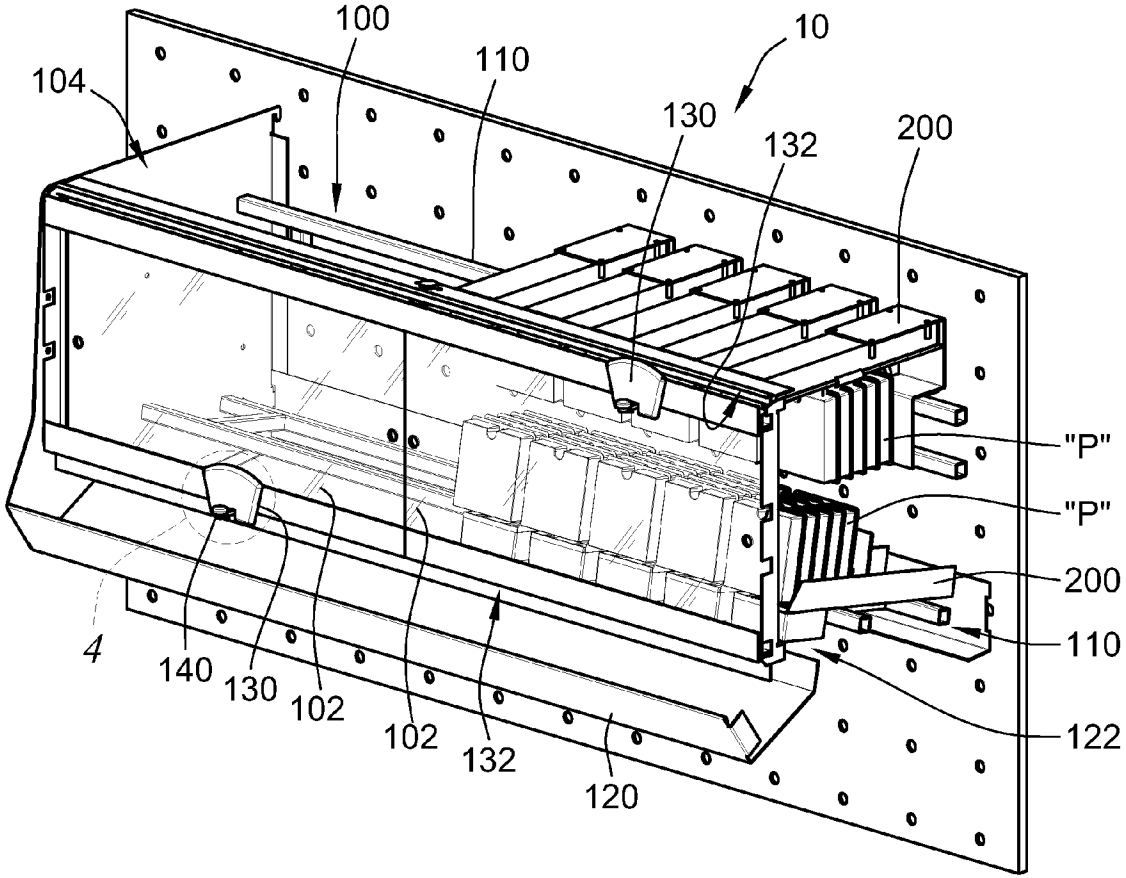
FIG. 1A is a front, perspective view of a product dispensing system in accordance with the present disclosure.
Figure 1B:
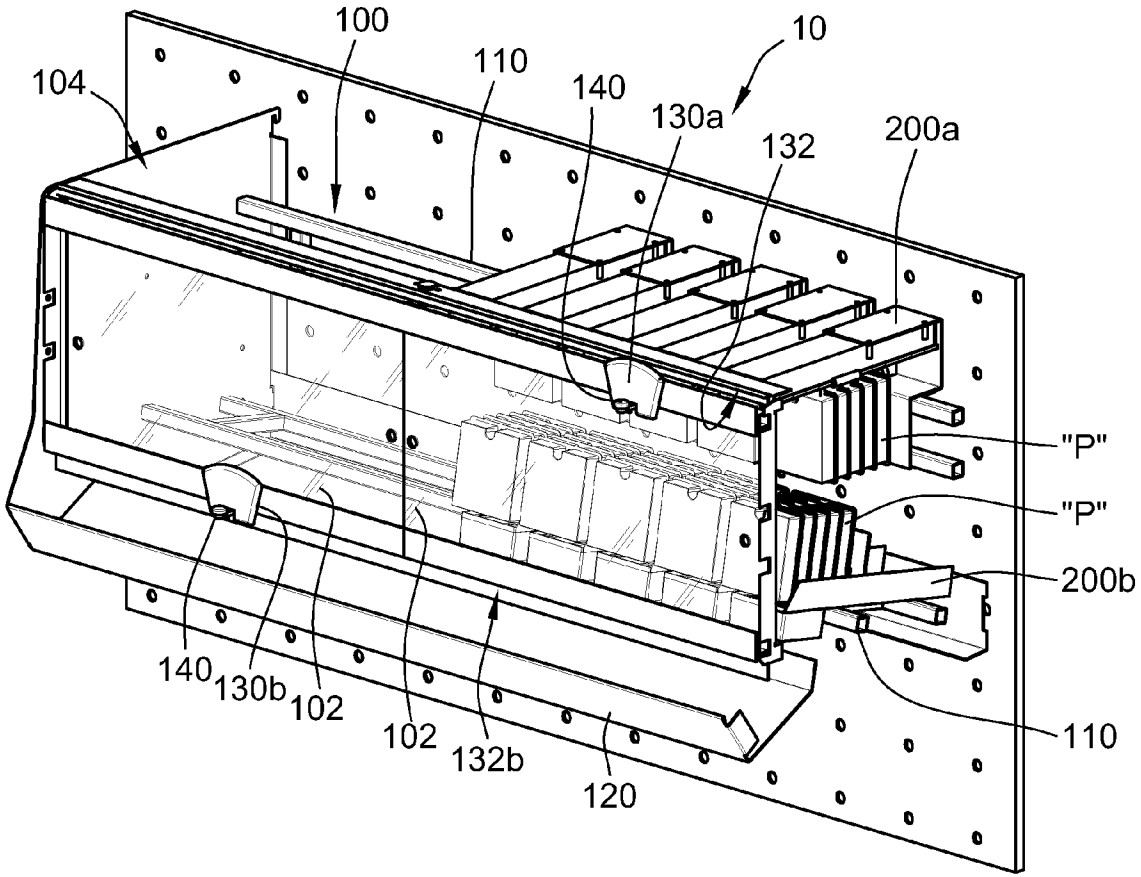
FIG. 1B is a top, perspective view of the product dispensing system of FIG. 1A.

Turning now to FIGS. 1A and 1B, a product dispensing system is shown identified by reference numeral 10. The product dispensing system 10 is illustrated mounted on an exemplary retail support wall or display. It will be recognized from the following that the product dispensing system 10 is not limited in its mounting to any particular style of retail support wall or display, and that illustrated in FIGS. 1A-1B should therefore be taken by way of example only.

Figure 2:
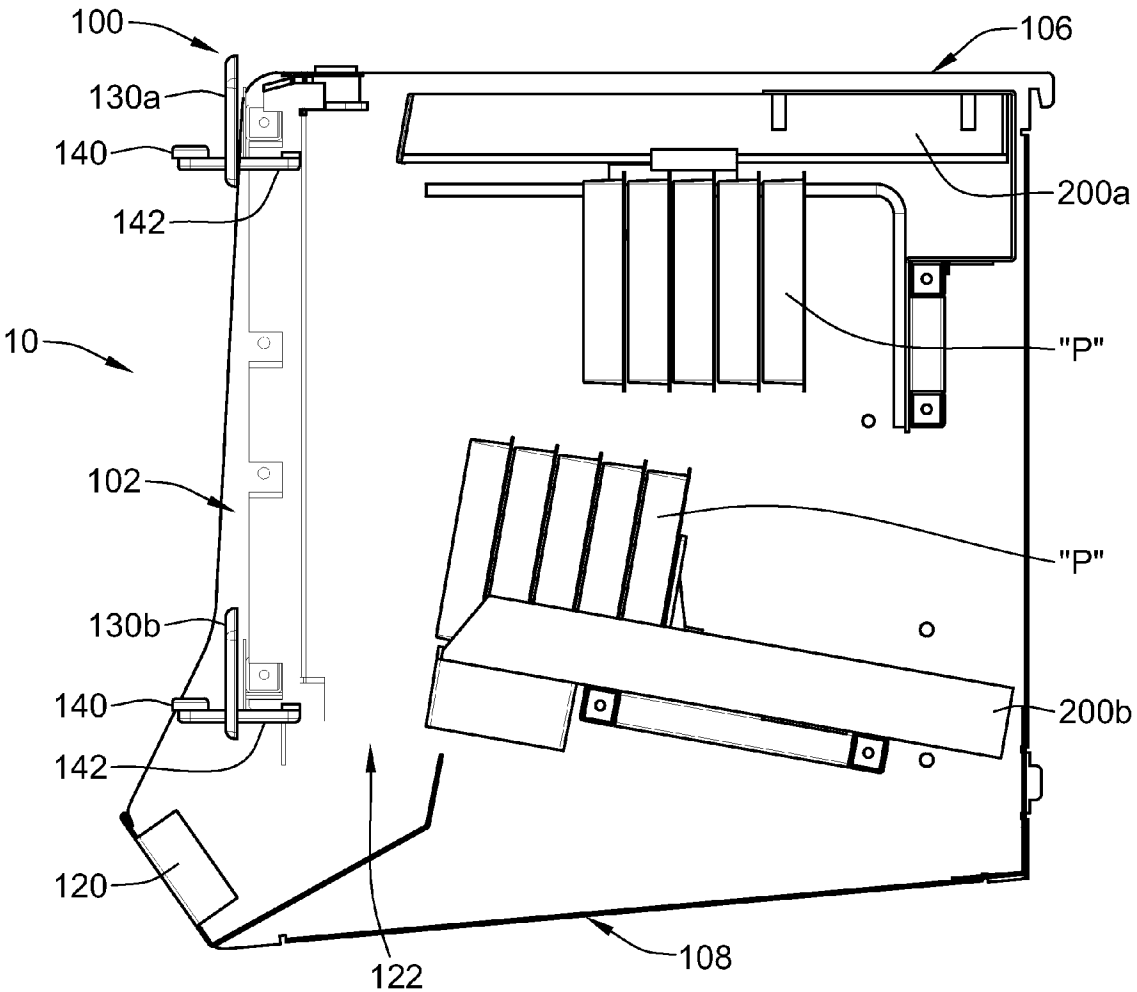
FIG. 2 is a side, cross-sectional view of the product dispensing system of FIG. 1A.

Product dispensing system 10 includes a display housing 100 having one or more transparent front display panels 102, a pair of side panels 104 (one of which has been removed for viewing purposes), a pair of rear mounting brackets 110 for mounting product dispensing system 10 to a wall or other structure, a top panel 106 (FIG. 2) and a bottom panel 108 (FIG. 2). A catch tray 120 extends from a bottom surface of display housing 100 for "catching" products "P" dispensed through a slot 122 defined within display housing 100. As can be appreciated, the specific dimensions and/or configuration of display housing 100 may be modified according the type, size and/or quantity of product (or products) to be used therein.

With reference now to FIG. 2, in conjunction with FIGS. 1A and 1B, one or more product retaining racks 200 is selectively positionable within display housing 100. Each product retaining rack 200 is configured to releasably retain a plurality of products "P" thereon. As shown in FIGS. 1A-2, display housing 100 includes a top product retaining rack 200*a* and a bottom product retaining rack 200*b* opposing top product retaining rack 200*a*. Top product retaining rack 200*a* is configured for "pegged" products "P" to hang therefrom, while bottom product retaining rack 200*b* is configured for retaining boxed, or packaged products "P" thereon. It is envisioned that greater or fewer top product retaining racks 200*a* and/or bottom product retaining racks 200*b* may be positioned within display housing 100 extending longitudinally along a length of display housing 100. Further, the product retaining rack(s) 200 may be positioned closer-together, or may be spaced-apart from one another depending on the size of the products retained thereon and/or the desired spacing of the products. Additionally, top and bottom product retaining racks 200*a*, 200*b*, respectively, need not oppose one another. For example, top product retaining rack(s) 200*a* may be positioned toward one side of display housing 100, while bottom product retaining rack(s) 200*b* are positioned toward the other side of display housing 100 for accommodating products of varying height. As can be appreciated, any number and/or configuration of product retaining racks 200 may be provided according to the quantity, size and type of products to be disposed within display housing 100.

With continued reference to FIGS. 1A-2, side panels 104 and top and bottom panels 106, 108, respectively, of display housing 100 may be made from a metal or hard plastic material for aesthetic purposes as well as for strength and durability. Mounting brackets 110 may also be made from a metal, hard plastic, or other suitable material having sufficient strength to support display housing 100 when display housing 100 is fully-loaded with products "P." As can be appreciated, when fully assembled and mounted to a wall or other structure, display housing 100 forms an enclosure that prevents unauthorized access to products "P" disposed within display housing 100, while slot 122 permits dispensed products "P" to exit display housing 100 and drop into catch tray 120 for retrieval by the customer.

Figure 3:
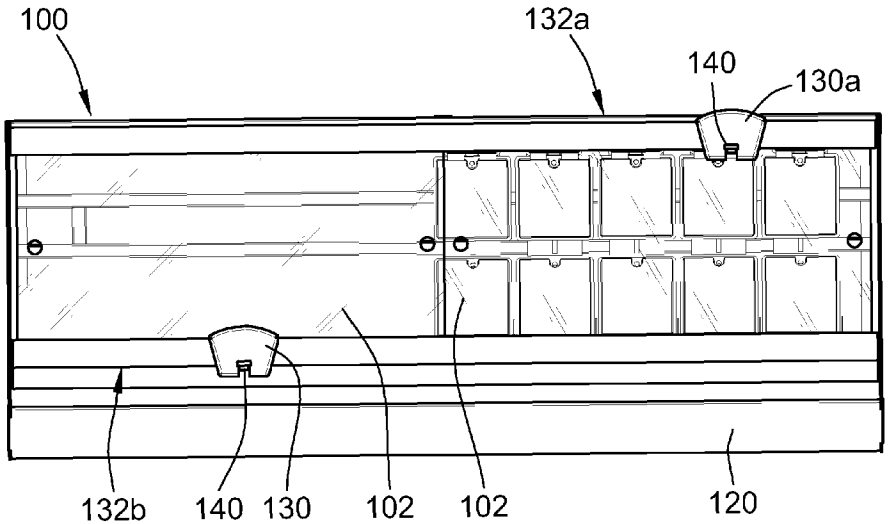
FIG. 3 is a front view of the product dispensing system of FIG. 1A.

Referring now to FIG. 3, display housing 100 includes two front display panels 102. Front panels 102 may be made from a transparent, break-resistant material such as plastic so as to permit visualization of the products "P" within display housing 100 but to inhibit unfettered access to the products "P." Further, front panels 102 may be configured as lockable sliding doors that may be unlocked by an employee to facilitate restocking of display housing 100.

Figure 4:
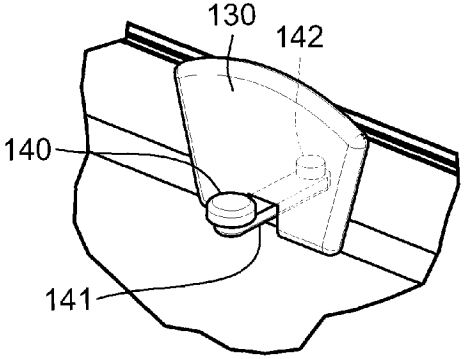
FIG. 4 is an enlarged view of the encircled area of FIG. 1A showing an actuator of the product dispensing system of FIG. 1A.

With continued reference to FIG. 3, in conjunction with FIGS. 1A, 1B and 4, display housing 100 may include one or more selectors in the form of sliders 130 positioned thereon and translatable along tracks 132 of display housing 100. More specifically, as shown in FIG. 3, a first slider 130*a* may be disposed on track 132*a* on a front end and toward a top of display housing 100, while a second slider 130*b* may be disposed on track 132*b* on the front end and toward a bottom of display housing 100. First and second sliders 130*a*, 130*b*, respectively, are slidable with respect to tracks 132*a*, 132*b*, respectively, along a length of display housing 100. Accordingly, first slider 130*a* may be selectively positioned adjacent top product retaining rack 200*a*, while second slider 130*b* may be selectively positioned adjacent bottom product retaining rack 200*b*. As can be appreciated, a customer may selectively translate the first or second slider 130*a*, 130*b*, respectively, to a position adjacent the respective top or bottom product retaining rack 200*a*, 200*b*, respectively, that retains the desired product thereon. An actuator 140 extends from each of sliders 130. Upon depression of actuator 140, as will be described in greater detail below, the forward-most product disposed on the adjacent product retaining rack 200 is released from the product retaining rack 200, falling into catch tray 120 for retrieval by the customer. In other words, sliders 130 and actuators 140 serves as the customer-controls for selecting and dispensing a desired product.

Figure 5:
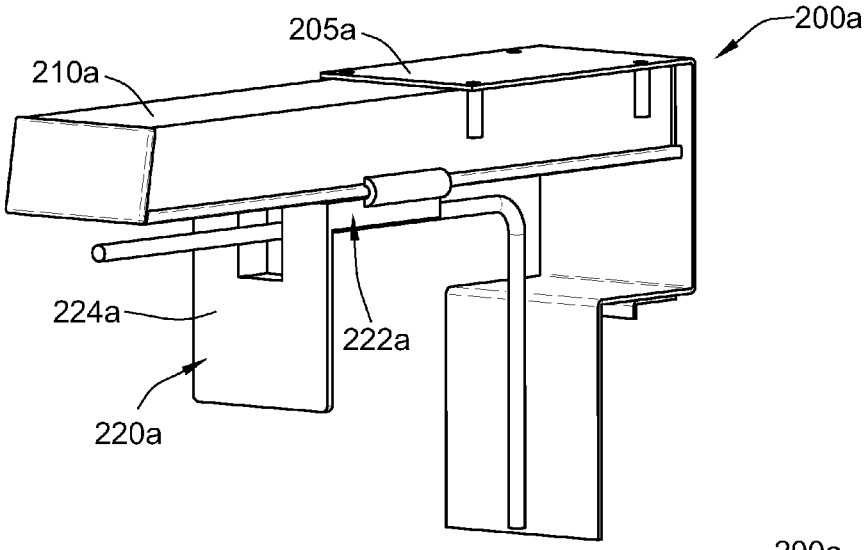
FIG. 5 is a perspective view of one embodiment of a product retaining rack for use with the product dispensing system of FIG. 1A.
Figure 6:
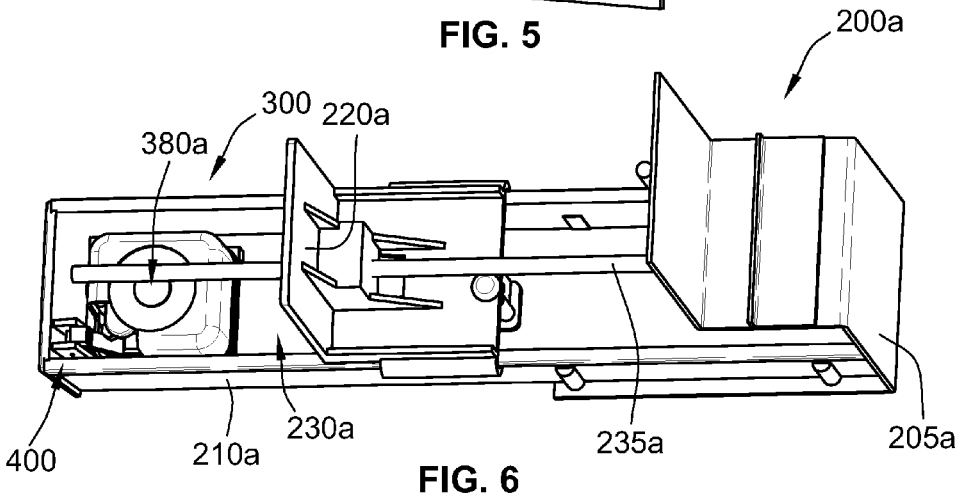
FIG. 6 is a bottom view of the product retaining rack of FIG. 5.

Top product retaining rack 200*a* will now be described in detail with reference to FIGS. 5-7. Top product retaining rack 200*a* generally includes a frame 205*a*, a drive housing 210*a*, a pusher 220*a*, and a product retaining member, or rod 235*a*. Frame 205*a* is disposed at a rear end of top product retaining rack 200*a* and is configured for engaging top product retaining rack 200*a* to one of the mounting brackets 110 of display housing 100 (see FIG. 2). Frame 205*a* may be configured for slidably-engaging mounting brackets 110 of display housing 100 (see FIG. 2) to facilitate the installation and positioning of a plurality of top product retaining racks 200*a* within display housing 100. Drive housing 210*a* houses drive assembly 300, which is coupled to pusher 220*a* via a drive cable, or string 230*a* for driving pusher 220*a* longitudinally along top product retaining rack 200*a*. More specifically, pusher 220*a* is engaged within a track 222*a* extending along top product retaining rack 200*a* to guide longitudinal translation of pusher 220*a*. Pusher 220*a* defines a generally planar front surface 224*a* for urging products "P," which are retained on product retaining member 235*a*, forward upon translation of pusher 220*a*. Drive assembly 300, which will be described in greater detail below, includes an actuation mechanism 400 for selectively actuating drive assembly 300 from an un-actuated, or "off" state to an actuated, or "on" state in which drive assembly 300 effects longitudinal translation of pusher 220*a*.

As mentioned above, top product retaining rack 200*a* includes a product retaining member 235*a* configured for retaining a plurality of products "P" thereon. As shown in FIGS. 5-7 product retaining member 235*a* is configured as an elongated rod 235*a* for retaining, or hanging a plurality of pegged products "P" stacked front-to-back thereon. However, it is envisioned that product retaining member 235*a* may be otherwise configured to accommodate products "P" of varying size, shape and/or packaging configurations. When stocked, products "P" are stacked forward of pusher 220*a* (pusher 220*a* is initially positioned at the rear end of top product retaining rack 200*a*) such that, upon actuation of drive assembly 300, pusher 220*a* is translated in a forward direction, urging the rear-most product forward, which, in turn urges the next rear-most product forward, and so on, such that the entire stack of products "P" is translated forward by pusher 220*a*. The internal components of drive assembly 300 and a more detailed description of the operation of top product retaining rack 200*a* will be described below.

Bottom product retaining rack 200*b* will now be described in detail with reference to FIGS. 8-9. Bottom product retaining rack 200*b* is similar to top product retaining rack 200*a* and generally includes a drive housing 210*b* that houses drive assembly 300, a body 240*b*, a pusher 220*b*, and a product divider 265*b*. Bottom product retaining rack 200*b* is configured for retaining a plurality of products "P" stacked front-to-beck along a top surface 242*b* of body 240*b* of bottom product retaining rack 200*b*. Product divider 265*b* separates products "P" stacked along different bottom product retaining racks 200*b* from interfering with one another and helps retain products "P" on top surface 242*b* of body 240*b* of bottom product retaining rack 200*b*. Bottom product retaining rack 200*b* may further include additional features for retaining products "P" of varying configurations thereon.

Drive assembly 300 of bottom product retaining rack 200*b* is coupled to pusher 220*b* via a drive cable, or string 230*b* for driving pusher 220*b* longitudinally along body 240*b* of bottom product retaining rack 200*b*. More specifically, as with top product retaining rack 200*a*, pusher 220*b* is engaged within a track 200*b* extending along bottom product retaining rack 200*b* for guiding the forward longitudinal translation of pusher 220*b* which, in turn, urges the stacked products "P" forward along top surface 242*b* of bottom product retaining rack 200*b*. Although oriented differently, the drive assemblies 300 of top and bottom product retaining racks 200*a*, 200*b*, respectively, are substantially similar.

Figure 8:
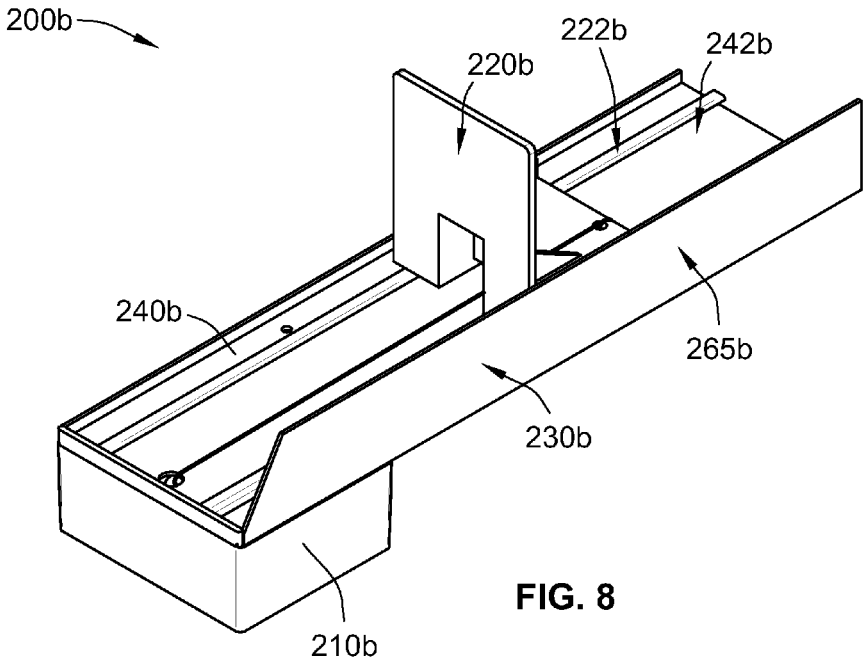
FIG. 8 is a perspective view of another embodiment of a product retaining rack for use with the product dispensing system of FIG. 1A.
Figure 9:
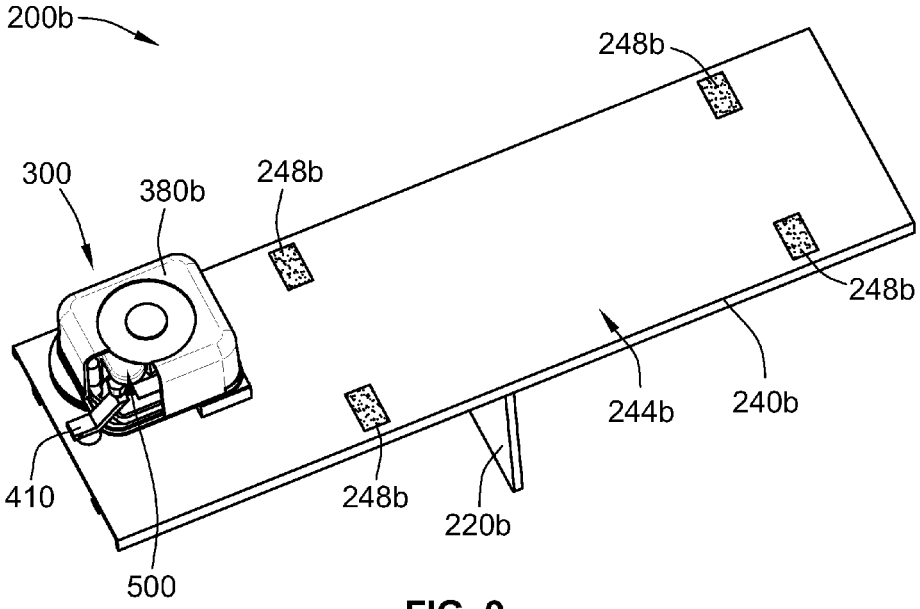
FIG. 9 is a bottom view of the product retaining rack of FIG. 8.

With continued reference to FIGS. 8 and 9, bottom product retaining rack 200*b* may include a plurality of engaging members 248*b* disposed on a bottom surface 244*b* thereof for releasably engaging bottom product retaining rack 200*b* to display housing 100 (FIGS. 1A-1B). For example, Velcro® or any other suitable releasable engaging member 248*b* may be used to facilitate the positioning, securing and/or re-positioning of bottom product retaining rack(s) 200*b* within display housing 100. Alternatively, bottom product retaining rack 200*b* may include a frame (not shown) for securing bottom product retaining rack 200*b* to mounting brackets 110 of display housing 100.

Drive assembly 300 will now be described with reference to FIGS. 10A-11. As mentioned above, top and bottom product retaining racks 200*a*, 200*b* respectively, each include a similar drive assembly 300. Therefore, to avoid repetition, drive assembly 300 will be described with reference to top product retaining rack 200*a*, keeping in mind that drive assembly 300 of bottom product retaining rack 200*b* is substantially similar.

Figure 7:
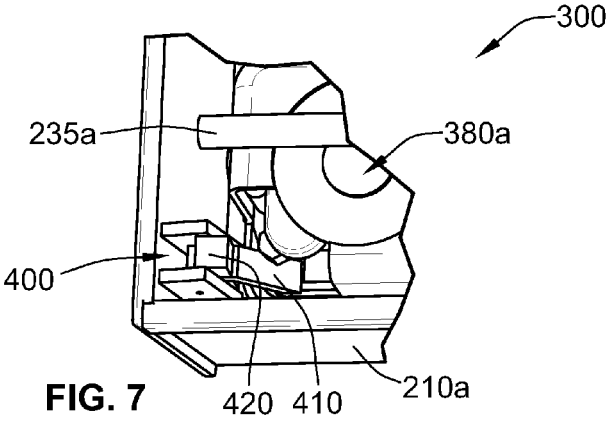
FIG. 7 is an enlarged view of a drive assembly for use with the product retaining rack of FIG. 5.
Figure 10A:
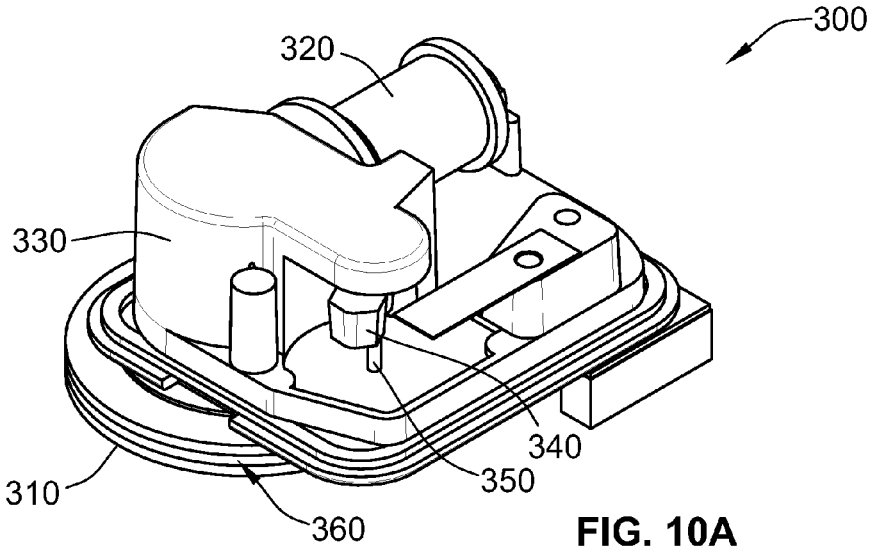
FIG. 10A is a perspective view of a drive assembly for use with the product dispensing system of FIG. 1A.
Figure 10B:
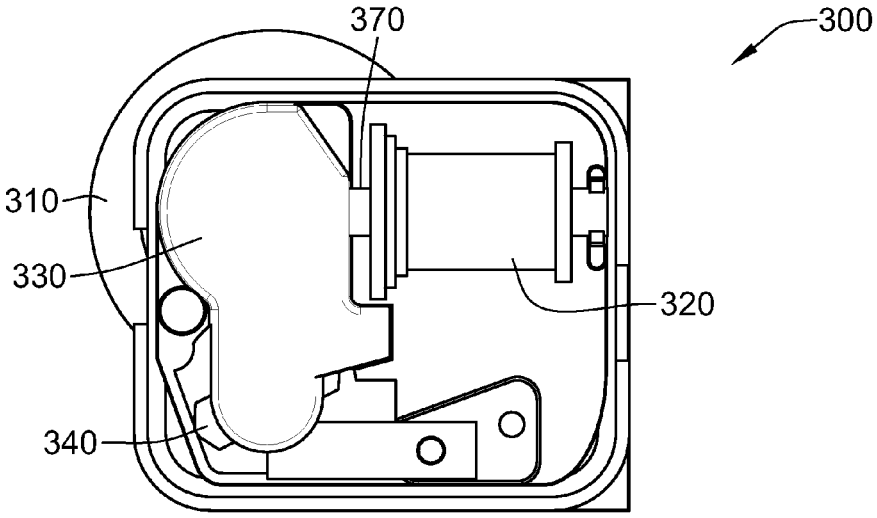
FIG. 10B is a top view of the drive assembly of FIG. 10A.
Figure 11:
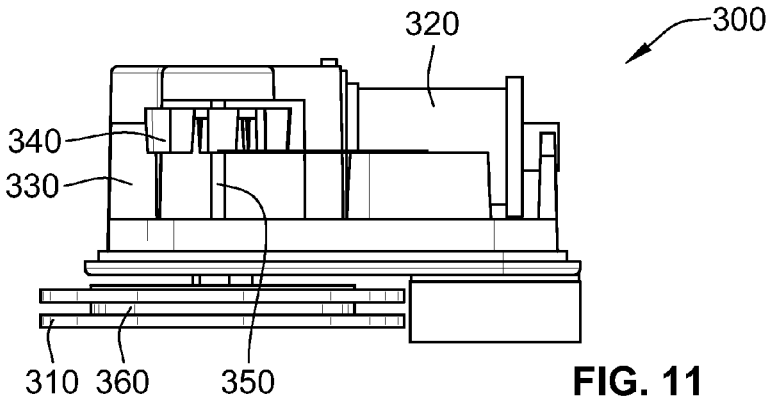
FIG. 11 is a side view of the drive assembly of FIG. 10A.

With continued reference to FIGS. 10A-11, in conjunction with FIG. 7, drive assembly includes a pulley 310, a cylinder 320, a gear box 330 and a governor 340 fixedly engaged to a threaded shaft 350. Pulley 310 is fixedly engaged to a reel 360 that extends through pulley 310 and upwardly into gear box 330. Gear box 330 houses one or more gears (not shown) and a torque spring (not shown) or other biasing member for biasing reel 360, and thus pulley 310, in a clockwise direction. The one or more gears (not shown) of gear box 330 are also coupled to cylinder 320, which, in turn, is coupled to threaded shaft 350 having governor 340 fixedly disposed thereon. Drive cable, or string 230*a* (see FIG. 6) is coupled at one end to reel 360 of pulley 310 and is configured to wind around pulley 310. Drive cable 230*a* (FIG. 6) extends from pulley 310, through an aperture (not explicitly shown) defined within top product mounting member 200*a*, along top product mounting member 200*a*, ultimately fixedly engaging pusher 220*a*. As can be appreciated, as reel 360 of pulley 310 is rotated under the bias of the torque spring (not shown) or other biasing member, drive cable 230*a* (FIG. 6) is wound around pulley 310, thereby pulling, or translating pusher 220*a* in a forward direction toward drive assembly 300. On the other hand, when pusher 220*a* is urged in a rear direction, away from drive assembly 300 (with sufficient force to overcome the bias of the torque spring or other biasing member), drive cable 230*a* is unwound from pulley 310, rotating pulley 310 and reel 360 in a counter-clockwise direction against the bias of the torque spring (not shown) or other biasing member.

As mentioned above, the gears (not shown) of gear box 330 are engaged to both reel 360 and to rotating cylinder 320 such that rotation of reel 360, e.g., due to the bias of the torque spring (not shown), effects rotation of the gears (not shown) of gear box 330, which, in turn, effects rotation of cylinder 320. Cylinder 320 is disposed about a bar 370 that is coupled to threaded shaft 350, which is fixedly coupled to governor 340. Thus, as cylinder 320 is rotated, threaded shaft 350 and, thus, governor 340 are also rotated.

Put simply, drive assembly 300 is configured such that, upon rotation of reel 360, the gears (not shown) of gear box 330 are rotated to rotate cylinder 320, which rotates threaded shaft 350 and governor 340. However, while reel 360 may "drive" drive assembly 300, fixing the position of any component part, e.g., preventing rotation of governor 340, stops the rotational movement of the entire drive assembly 300. Further, the rotational speed of one of the components, e.g., rotatable governor 340, may be used to set the relative rotational speed of any of the component parts of drive assembly 300.

Accordingly, governor 340 may be configured to rotate at a constant, pre-determined rotational speed, thereby helping to ensure that pulley 310 is rotated at a constant rotational speed such that pusher 220*a* is pulled, or translated along top product retaining rack 200*a* constantly at the desired speed. Thus, drive assembly 300 may be configured as a slow-move drive assembly 300. In other words, upon activation, drive assembly 300 may be configured to translate pusher 220*a* relatively slowly along top product retaining rack 200*a* such that the products "P" are translated slowly along top product retaining rack 200*a*. As can be appreciated, in such an embodiment, the slow-move drive assembly 300 dispenses products "P" incrementally, i.e., one at a time. Although prolonged activation of drive assembly 300 will eventually dispense multiple products "P" in an incremental fashion, shoplifters would be prevented from quickly retrieving a large quantity of products "P" in a relatively short period of time. Further, drive assembly 300 may be customized e.g., by varying the configuration and/or type of governor 340, to increase or decrease the length of time required to dispense a single product.

As mentioned above, drive assembly 300 is selectively actuatable from an un-actuated, or "off" state, wherein drive assembly 300 is not being rotating and, thus, wherein pusher 220*a* is fixed relative to top product retaining rack 200*a*, to an actuated, or "on" state, wherein reel 360 is rotated in a clockwise direction, winding drive cable 230*a* about pulley 310 and translating pusher 220*a* forwardly along top product retaining rack 200*a*. Also as mentioned above, governor 340 (or any other rotating component of drive assembly 300) may be fixed, or retained in a fixed position to inhibit rotational movement of drive assembly 300.

Accordingly, an actuation mechanism 400 is provided for turning drive assembly "on" and "off." More specifically, actuation mechanism 400 is configured to move between a first position, wherein lever 410 contacts governor 340, inhibiting rotational movement of governor 340 and, thus, inhibiting rotational movement of drive assembly 300, and a second position, wherein lever 410 is displaced from governor 340, permitting governor 340 and drive assembly 300 to rotate under the bias of the torque spring (or other biasing mechanism). As can be appreciated, when lever 410 of actuation mechanism 400 is in the first position, drive assembly 300 is un-actuated, or "off." On the other hand, when lever 410 of actuation mechanism 400 is moved to the second position, drive assembly 300 is activated, or turned "on." Further, actuation mechanism 400 may be biased toward the first position, thereby biasing drive assembly 300 toward the "off" state.

With reference now to FIGS. 1A, 4, 7 and 10A, in one embodiment, actuation mechanism 400 may be magnetically-actuated. In other embodiments, actuation mechanism 400 may include other magnetic, mechanical and/or electrical components. In embodiments wherein actuation mechanism 400 is magnetically-actuated, actuator 140 of slider 130*a* may include a lever 141 having a magnet 142 rotatably disposed thereon and lever 410 of actuation mechanism 400 may include a magnet 420 fixedly disposed thereon. When slider 130*a* is positioned adjacent actuation mechanism 400 of top product retaining rack 200*a* and actuator 140 is depressed (and maintained in a depressed state), magnet 142 of actuator 140 is rotated such that magnet 420 and magnet 140 repel one another, i.e., such that similar magnetic poles of magnets 420 and 140 are positioned adjacent one another. As a result of the repulsive forces of magnets 420 and 140, magnet 420 is rotated, thereby rotating lever 410 out of the path of governor 340. With lever 410 no longer obstructing the rotation of governor 340, i.e., with lever 410 in the second position, drive assembly 300 is actuated, or turned "on," thereby translating pusher 220*a* and the products "P" disposed on top product retaining rack 200*a* forward. Upon release of actuator 140, lever 410 is returned to the first position and drive assembly 300 is turned "off."

Additionally, as shown in FIG. 9, drive assembly 300 may include a confirmation mechanism 500 configured to produce an audible output when drive assembly 300 is actuated, i.e., when drive assembly 300 is "on." In such embodiments, one of the gears (not shown) of gear box 330 may be coupled to a resilient member (not shown) that is configured to repeatedly "tap" against an upper surface of drive assembly cover 380*b* as the gear (not shown) is rotated. As such, the confirmation mechanism 500 is configured to audibly notify the customer that drive assembly 300 is actuated and that the product will soon be dispensed into catch tray 120. Such a feature is advantageous in that customers may be unsure whether the drive assembly 300 is working, especially where drive assembly 300 is in a slow-move drive assembly 300. Further, it is envisioned that any other suitable confirmation mechanism 500 for alerting the customer (via audible, tactile and/or visual signal) of actuation of drive assembly 300 may be provided.

The operation of product dispensing system 10 will now be described with reference to FIGS. 1A-11. Initially, the customer views the products "P" disposed within display housing 100 through transparent front panels 102. When the customer has decided on a product to be dispensed, the customer slides the slider (either top slider 130*a* or bottom slider 130*b*, depending on the product chosen) along display housing 100 to a position adjacent the desired product. Next, the customer depresses actuator 140 which, in turn, actuates the drive assembly 300. Drive assembly 300 pulls, or translates pusher 220 forward (via drive cable 230) and pusher 220 translates the stack of products "P" forward along the product retaining rack (either top product retaining rack 200*a* or bottom product retaining rack 200*b*, depending on the product chosen). In embodiments wherein confirmation mechanism 500 is provided, the customer would, at this point, be alerted, e.g., via the audible "clicking" of drive assembly 300, that drive assembly 300 is actuated.

Eventually, upon continued depression of actuator 140, the forward-most product reaches the forward end of the product retaining rack 200 and is disengaged from the product retaining rack 200. Once disengaged, the product falls through slot 122 defined within display housing 100 and into catch tray 120. From there, the customer may easily retrieve the selected product. As can be appreciated, the process may be repeated for dispensing additional products "P".

With reference now to FIGS. 1A and 1B, the restocking of product dispensing system 10 is now described. To restock product dispensing system 10, sliding front panels 102 of display housing 100 are unlocked and moved away from the product retaining rack 200 to be restocked. Next, the employee simply hangs (for top product retaining racks 200*a*) or stacks (for bottom product retaining racks 200*b*) the products "P" front-to-back along the product retaining rack 200 and pushes rearwardly to move the pusher 220 to the rear end of the product retaining rack 200. When restocking is complete, the front panels 102 are replaced and relocked.

Figure 12:
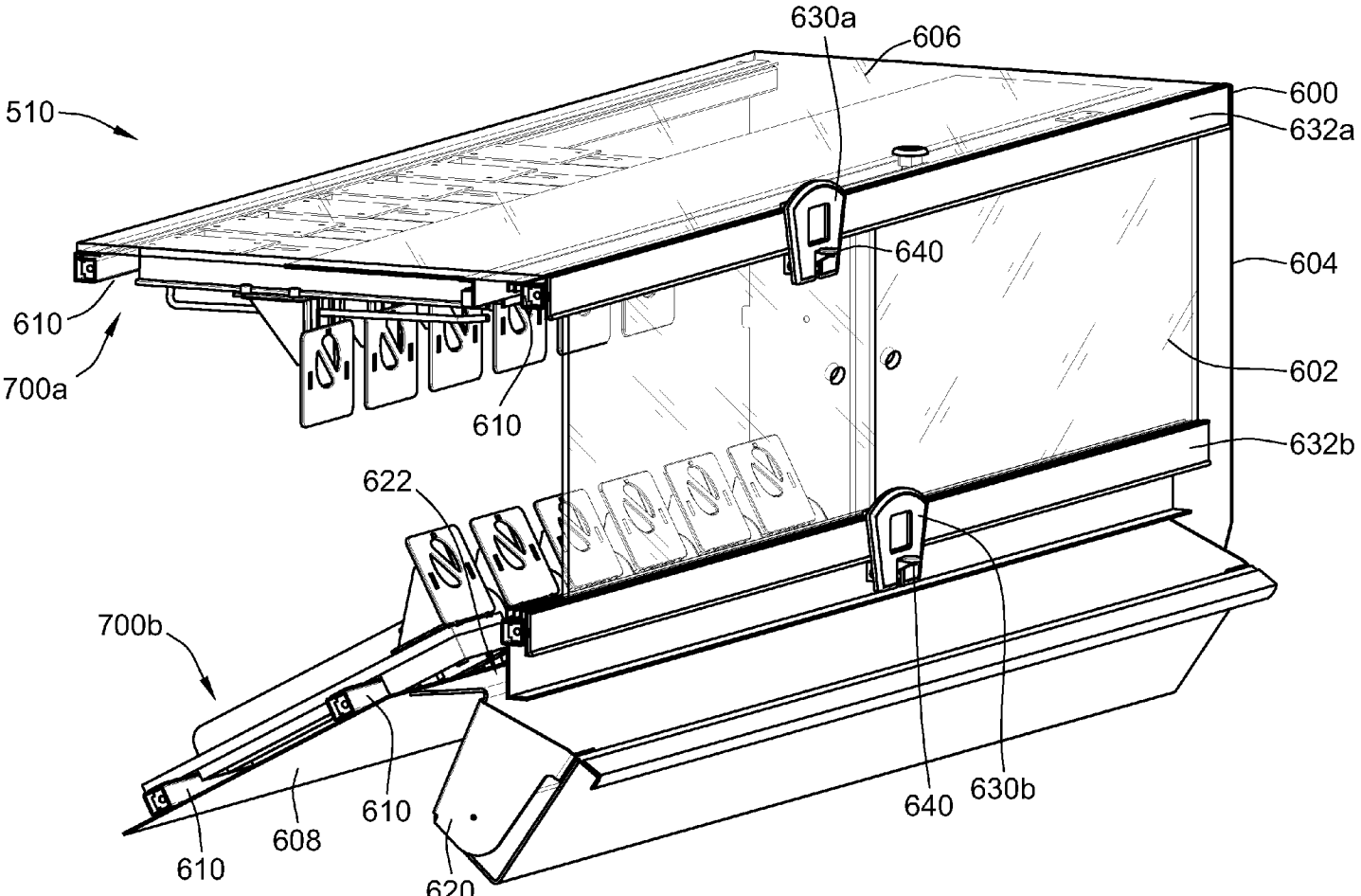
FIG. 12 is a perspective view of another embodiment of a product dispensing system.

Turning now to FIGS. 12-22, another embodiment of a product dispensing system 510 is illustrated. This embodiment is similar to that discussed above in that it provides a customer accessible product dispensing system that helps prevent theft in large quantities without the need for additional security and/or assistance by an employee. Turning now to FIG. 12, product dispensing system 510 includes a display housing 600 having one or more transparent front display panels 602 extending between a pair of sidewalls 604 (one of which has been removed for viewing purposes). The display housing 600 also includes a top panel 606 and a bottom panel 608. Mounting brackets 610 are also provided for receiving product retaining racks 700*a* and 700*b*, as well as for mounting the product dispensing system 510 to a retail support structure such as that illustrated in FIGS. 1A and 1B. Additionally, the sidewalls 604 may also be configured for mounting the product dispensing system 510 to a retail support wall or structure.

In a similar manner as discussed above, the product dispensing system 510 illustrated in FIG. 12 encases product retaining racks 700*a* and 700*b*. A first slider 630*a* and a second slider 630*b* are also provided to allow a customer to dispense merchandise from the product dispensing system 510. The first and second slider 630*a*, 630*b* are slidable along tracks 632*a*, 632*b* similar to the operation discussed above relative to FIGS. 1-11. Each slider 630*a*, 630*b* includes an actuator 640 that upon depression will cause an item of retail merchandise to fall into catch tray 620.

While the general advantages and operation of the product dispensing system 510 is similar to that described above relative to FIGS. 1-11, it will be recognized from the following that the mounting and design of the product retaining racks 700*a*, 700*b* as well as the design and operation of the catch tray 620 differs from that shown in FIGS. 1-11 above. Each of these aspects will be described in turn in the following.

Figure 13:
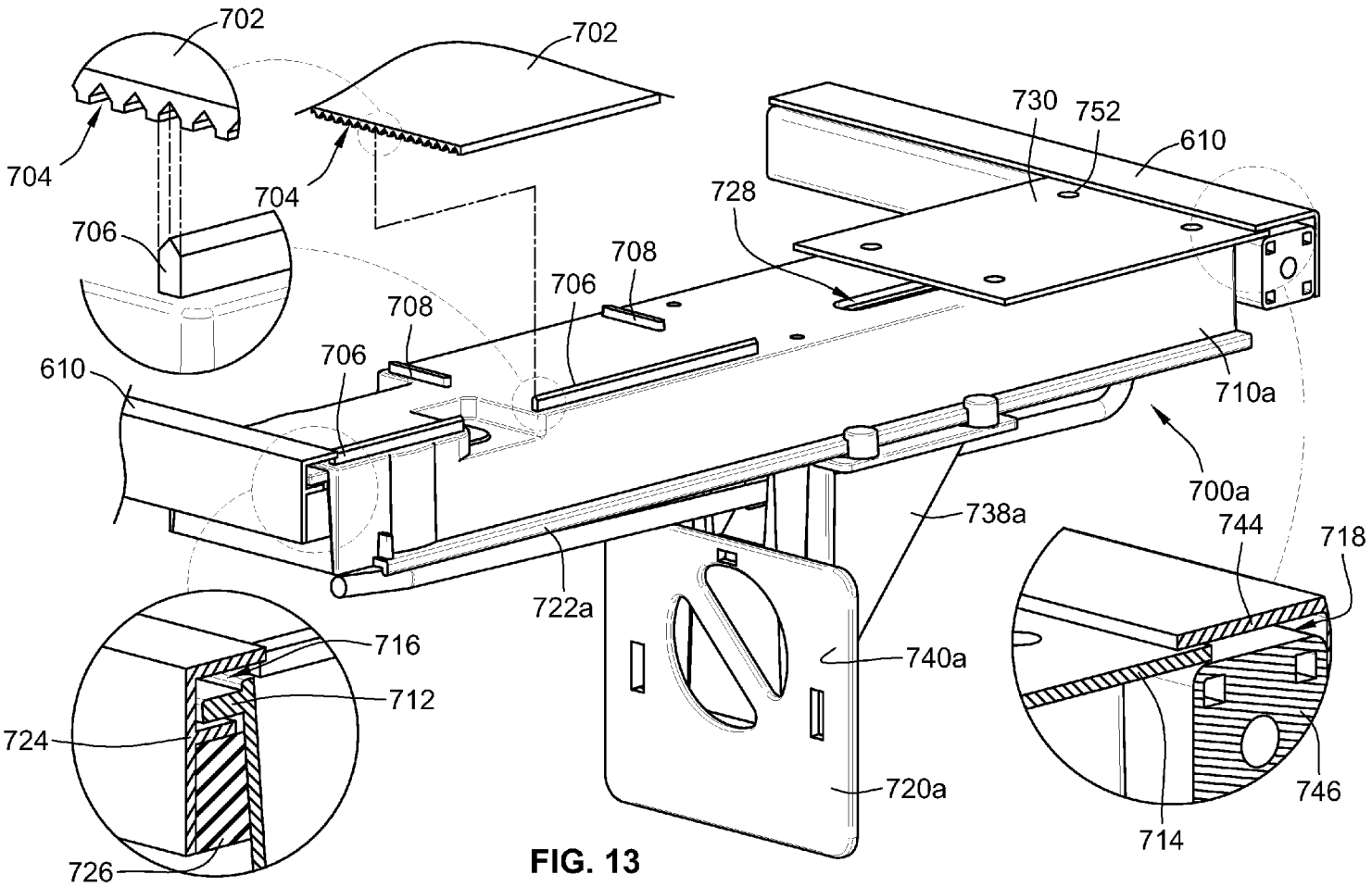
FIG. 13 is a perspective view of a top product retaining rack of the product dispensing system of FIG. 12.

Turning now to FIG. 13, an exemplary embodiment of the top product retaining rack 700*a* is illustrated. Similar to the top product retaining rack of FIGS. 5-7, the top product retaining rack 700*a* includes a drive housing 710 for receiving drive assembly 300 (see FIG. 10A-11). The drive housing 710*a* also provides a track 722*a* for slidably receiving a pusher 720*a*. The pusher 720*a* is slidable along the track 722*a* upon actuation of the drive mechanism 300 in a similar manner as described above.

The top product retaining rack 700*a* also includes a product retaining member 734 for carrying retail merchandise thereon. Product retaining member 734 is in the form of a retail merchandise hook that extends through a slot 728 formed in the drive housing 710*a*. The product retaining member 734 is affixed to a backing plate 730 mounted to a top of the drive housing 710*a* via mounting apertures 732.

The top product retaining rack 700*a* is mounted directly between mounting brackets 610 as illustrated. Specifically, the top product retaining rack 700*a* includes front and rear engagement ribs 712, 714 for releasably affixing the top product retaining rack 700*a* between the mounting brackets 610 as illustrated. The forward most mounting bracket 610 includes a support frame 724 and resilient pad 726. The support frame 724 provides a receiving slot 716 for receiving the front engagement rib 712.

Similarly, the rear mounting bracket 610 also includes a support frame 744 as well as a support bar 746. The support frame 744 and support bar 746 define a receiving slot 718 therebetween. As illustrated, the receiving slot 718 receives the rear engagement rib 714.

The resilient pad 726 is compressible to allow the installation of the top product retaining rack 700*a* between the front and rear mounting bracket 610. However, upon compression, and once both the front and rear engagement ribs 712, 714 are positioned within their respective slots 716, 718, the resilient pad 726 will bias the top product retaining rack 700*a* into abutted contact with the support bar 746 of the rear mounting bracket 610. As a result, the top product retaining rack 700*a* may be easily installed by positioning the leading or front engagement rib 712 into the front receiving slot 716 and pulling the top product retaining rack 700*a* forward until the rear engagement rib 714 will seat within the rear receiving slot 718. Such a configuration fixedly retains the top product retaining rack 700*a* between the front and rear mounting brackets 610, while providing easy installation and removal of the same.

The top product retaining rack 700*a* also includes an alignment rib 706 formed on a top of the drive housing 710*a*. The alignment rib 706 is received within one of a plurality of generally parallel alignment grooves 704 formed in an alignment plate 702 affixed to or forming part of the top panel 606 (see FIG. 12). The alignment rib 706 and alignment grooves 704 cooperate to ensure that adjacent product retaining racks 700*a* are positioned between the front and rear mounting bracket 610 in a generally parallel fashion. One or more standoffs 708 are provided generally transverse to the alignment rib 706 to ensure that a top surface of the drive housing 710*a* remains generally parallel to the alignment plate 702 or top panel 606.

Figure 14:
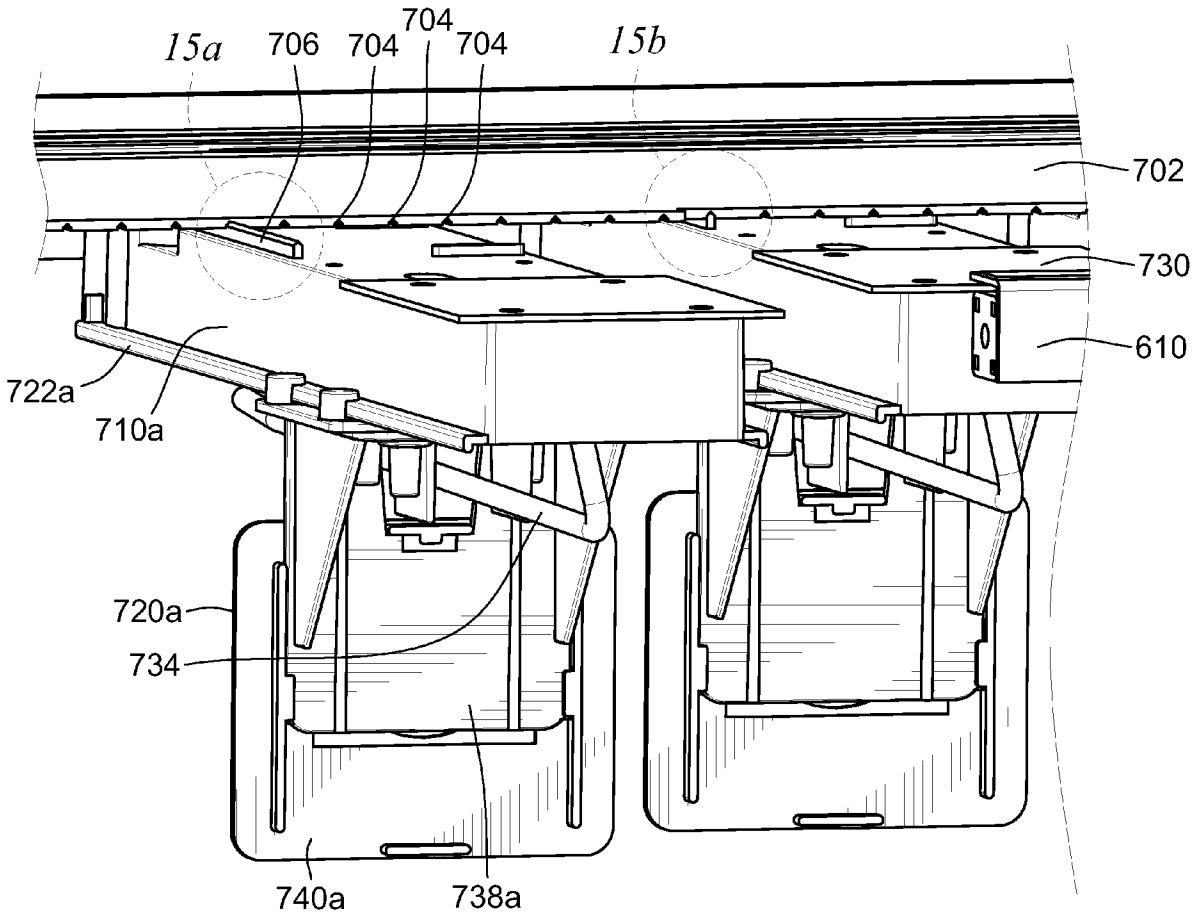
FIG. 14 is a rear perspective view of adjacent top product retaining racks of the product dispensing system of FIG. 12.
Figure 15B:
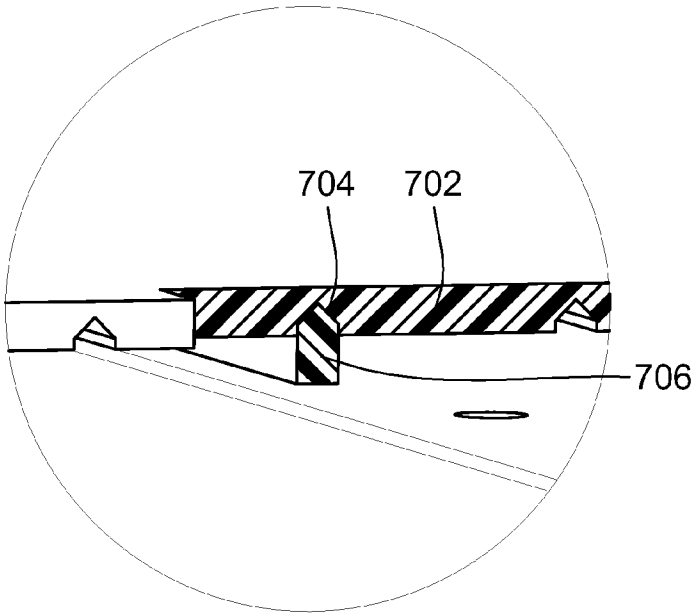
FIGS. 15A-15B are partial perspective views of an alignment rib of the top product retaining rack of FIG. 13 installed within an alignment groove of an alignment plate of the product dispensing system of FIG. 12.
Figure 15A:
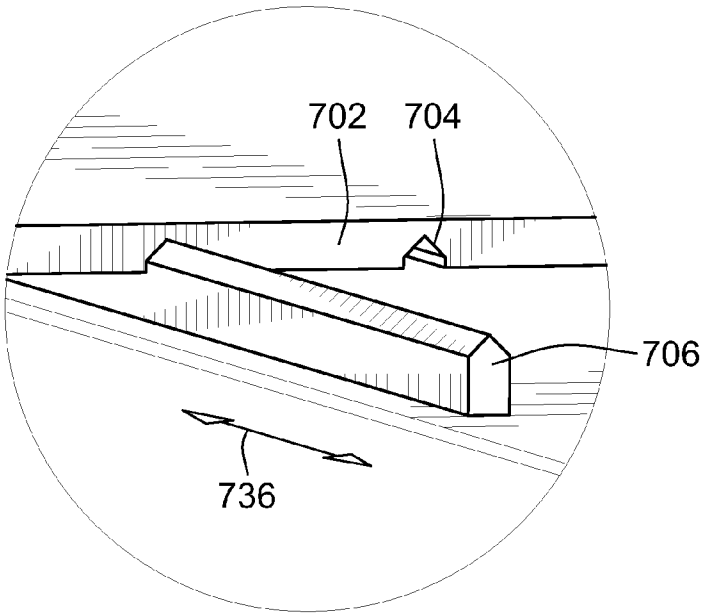

As a result, the retailer or installation technician need not spend additional time ensuring the proper alignment of adjacent top product retaining racks 700*a*. Referring momentarily to FIG. 14, the generally parallel orientation between adjacent top product retaining racks 700*a* is illustrated. Referring briefly to FIGS. 15A and 15B, the alignment ribs 706 are slidable in direction 736 within a select one of the alignment grooves 704 formed in the alignment plate 702. As illustrated at FIG. 15B, the alignment rib 706 will seat within the alignment groove 704 so that the tendency of adjacent top product retaining racks 700*a* to come out of parallel with one another is generally minimized.

Referring back to FIG. 13, the pusher 720*a* includes a base 738*a* and a pusher plate 740*a* releasably connected to the base 738*a*. The base 738*a* may receive other configurations of pusher plates depending upon the size and geometry of the merchandise carried by the top product retaining rack 700*a*.

Figure 16:
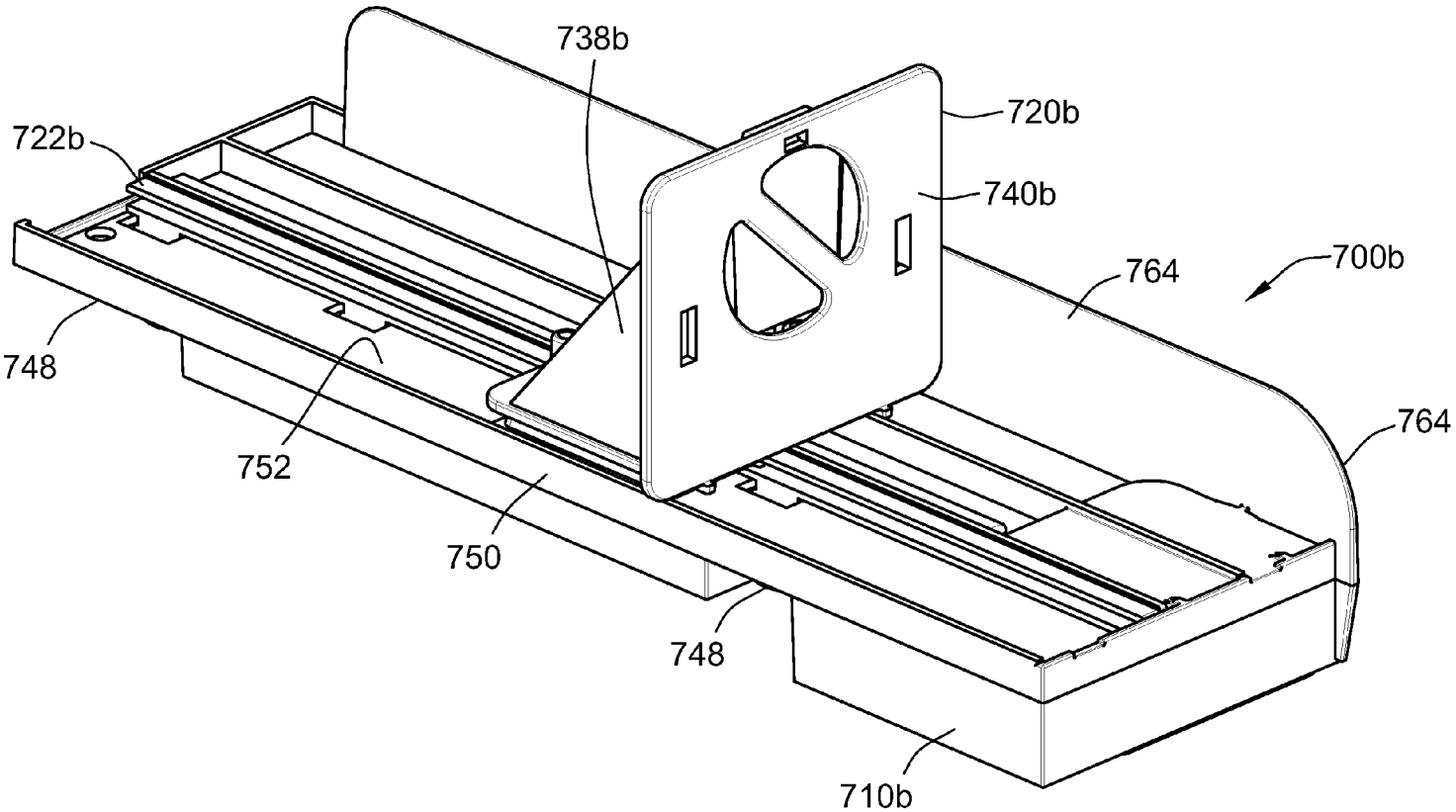
FIG. 16 is a perspective view of a bottom product retaining rack of the product dispensing system of FIG. 12.

Turning now to the bottom product retaining rack 700*b* illustrated in FIG. 16, the same also incorporates a pusher 720*b* having a base 738*b* and pusher plate 740*b*. The bottom product retaining rack 700*b* also includes a drive housing 710*b* for containing a drive assembly 300 as described above. The pusher 720*b* is slidable along a track 722*b* carried by a body 750 of the bottom product retaining rack 700*b*. The drive assembly 300 biases the pusher 720*b* forward along track 722*b* via a cable 230 (see FIG. 8) in a similar manner as that described above relative to FIGS. 8 and 9. The bottom product retaining rack 700*b* mounts to lower mounting brackets 610 (see FIG. 12) by way of engaging members 748 similar to the engaging members 248 described above relative to FIG. 9. A product divider 764 is also provided on one side of the lower product retaining rack 700*b*. The product divider 764 is operable to divide adjacent rows of retail merchandise when utilizing multiple bottom product receiving racks 700*b*.

Figure 17:
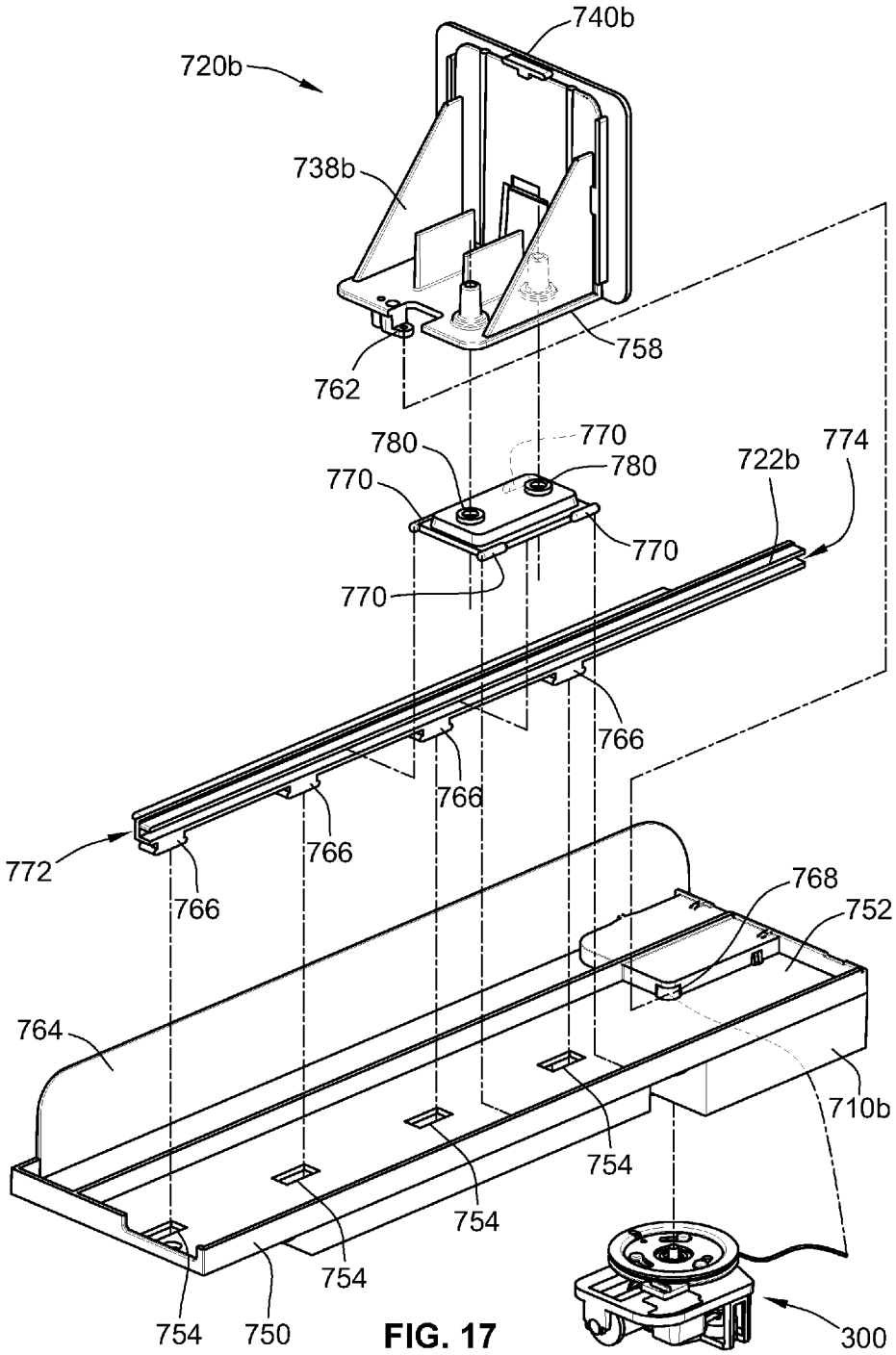
FIG. 17 is an exploded perspective view of the bottom product retaining rack of FIG. 16.

Turning now to FIG. 17, the assembly of the bottom product retaining rack 700*b* is illustrated in greater detail. The track 722*b* includes a plurality of track mounting tabs 766 that are received by track apertures 754 formed in a top surface 752 of the body 750. The cable of the drive assembly 300 passes through an aperture 768 of the body 750 and is affixed to a cable receiver 762 depending downward from a bottom surface 758 of the frame 738*b* of the pusher 720*b*.

A pusher guide 760 is also mounted to the bottom surface 758 of the frame 738 via mounting apertures 780. The pusher guide 760 includes a plurality of guide ribs 770 for slidably guiding the pusher 720*b* along the track 722*b* and along the body 750.

Figure 18:
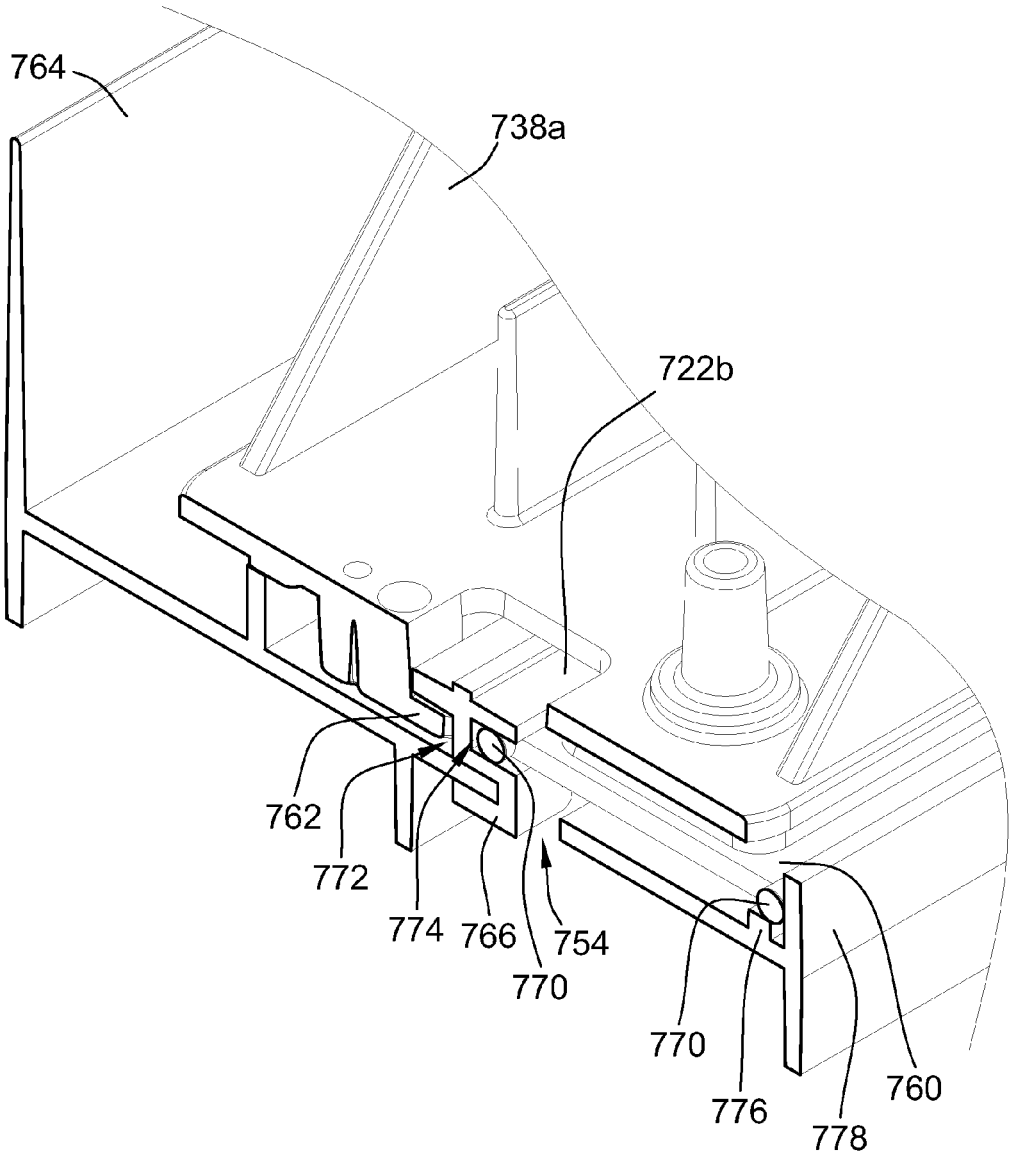
FIG. 18 is partial perspective cross section of the bottom product retaining rack of FIG. 16.

With reference to FIG. 18, when the track 722*b* is mounted to the body 750 via apertures 754, at least one of the guide ribs 770 of the pusher guide 760 is positioned within a channel 774 of the track 722*b*. At least one other one of the guide ribs 770 slides along a guide rail 776 extending upward from the top surface 752 of the body 750. As illustrated, this guide rib 770 also slidably contacts a sidewall 778 opposite the side of the body 750 providing the divider wall 764.

The track 722*b* also provides a second channel 772 adjacent to the channel 774 receiving at least one of the guide ribs 770. This channel 772 receives the cable receiver 762 and also a length of unwound cable extending from the drive assembly 300 (not shown). It will be recognized that one advantage of providing a removable track 722*b* is the low cost replacement of the same in the event it becomes broken or worn down due to repeat sliding contact between the track 722*b* and the pusher guide 760 and more particularly the guide ribs 770.

Figure 19:
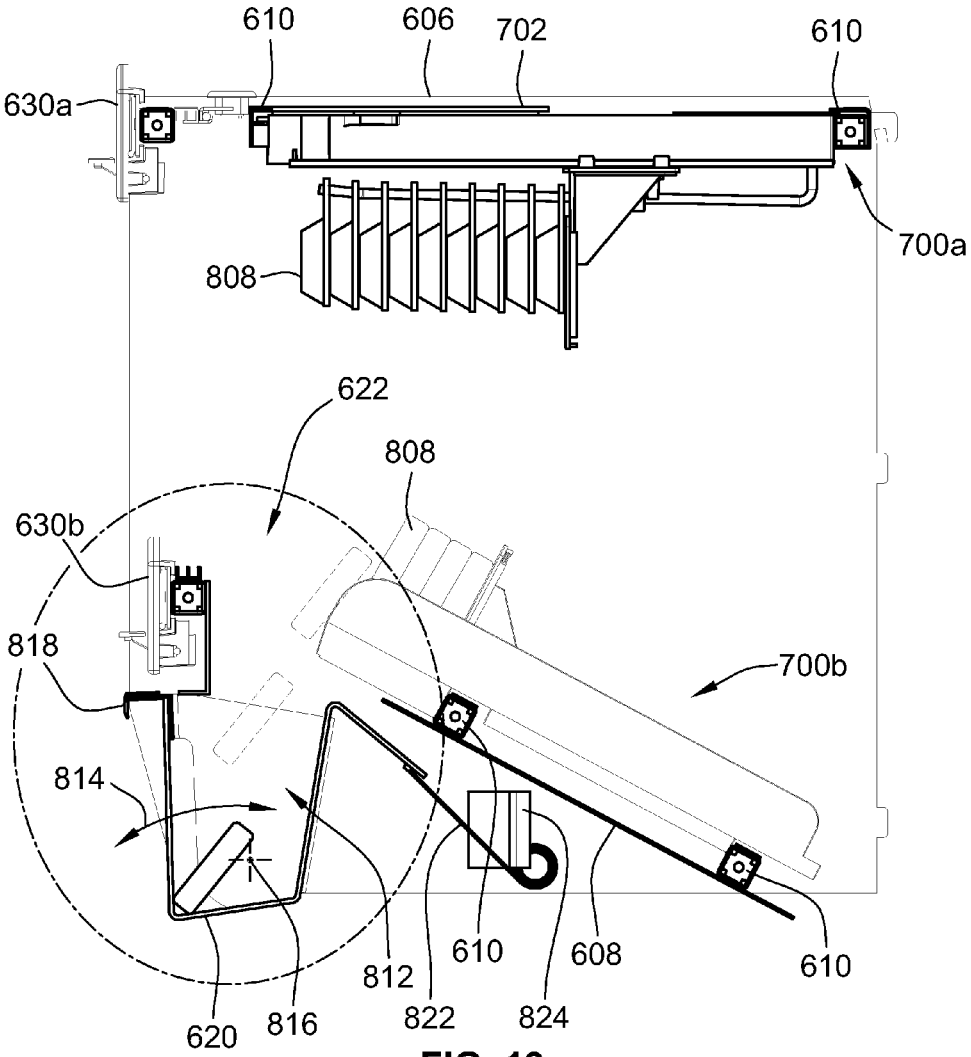
FIG. 19 is a side view of the product dispensing system of FIG. 12.

Having described the general structural and mounting configurations of the top and bottom product retaining rack 700*a*, 700*b*, a description will now be provided relative to the catch tray 620 illustrated in FIG. 19. The catch tray 620 is generally aligned with slot 622 in a similar manner as described above relative to FIGS. 1A and 1B. As merchandise 808 is biased off either of the top or bottom product retaining rack 700*a*, 700*b*, it will fall through the slot 622 and into a product containment area 812 of the catch tray 620. Thereafter, a customer may remove the merchandise 808 from the catch tray 620, and more particularly the product containment area 812, as described below.

The catch tray 620 is rotatably mounted to the sidewalls 604 at a pivot 816. As a result, the catch tray 620 is rotatable along rotational direction 814. More specifically, prior to dispensing merchandise from either one of the top or bottom product retaining racks 700*a*, 700*b*, the catch tray 620 is rotated along direction 814 and about pivot 816 into the orientation illustrated in FIG. 19. Once merchandise 808 falls into the product containment area 812, a customer may pull handle 818 to rotate the catch tray 620 forward along direction 814 and about pivot 816 to provide customer access to the merchandise 808 in the product containment area 812.

Figure 21:
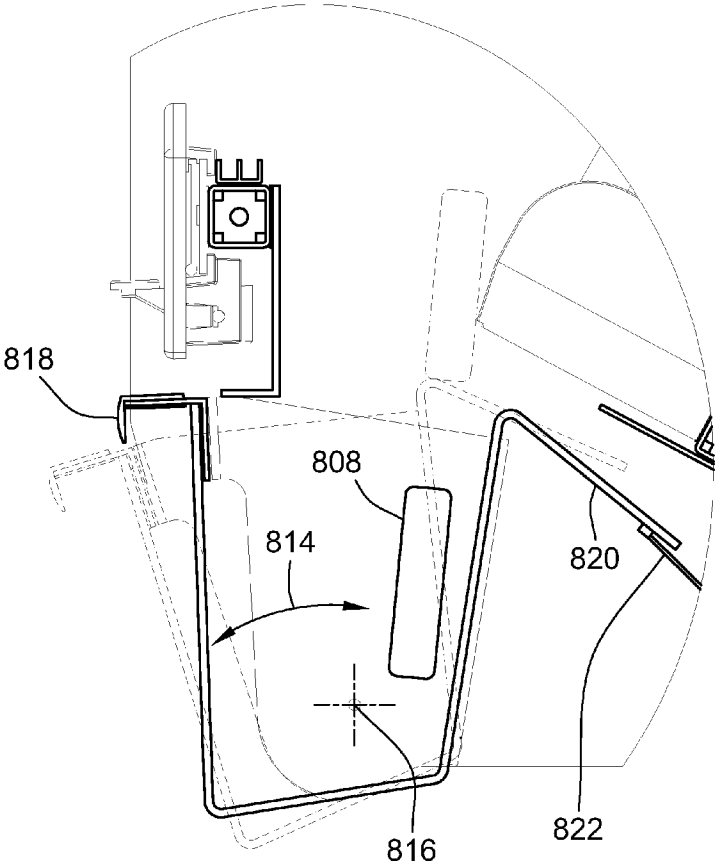
FIGS. 20-21 are side views of a catch tray of the product dispensing system of FIG. 12.
Figure 20:
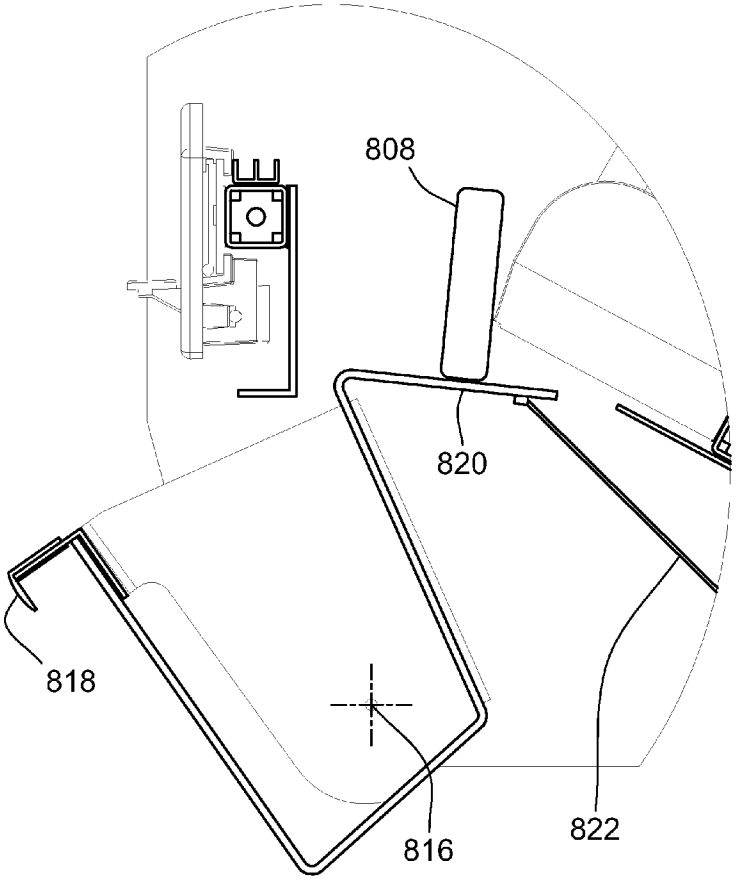

The catch tray 620 can include a biasing element in the form of a constant force spring 822 to automatically bias the catch tray 620 back along direction 814 once the customer has released the handle 818. As illustrated at FIGS. 19-21, an uncoiled end of the spring 822 is affixed to the catch tray. The remaining coiled portion of the spring 822 is carried by a mounting bracket 824 affixed to an interior side of one of the sidewalls 604. As the catch tray 620 rotates forward, the spring 822 is uncoiled from its mounted position at the mounting bracket 824. Upon release of the catch tray 620 by a customer, the spring 822 will recoil to bias the catch tray 620 back to a closed position.

Additionally, and with reference now to FIG. 20, the catch tray 620 can also incorporate a rearwardly extending shield 820 extending along the length of the catch tray 620. The shield 820 is provided to prevent merchandise from falling below the bottom product retaining racks 700*b* in the event the catch tray 620 is rotated forward while dispensing merchandise from either one of the top or bottom product retaining rack 700*a*, 700*b*. As illustrated in FIG. 20, in the event this occurs, the merchandise 808 will land on top of the shield 820. Thereafter, when the catch tray 620 is rotated back to the configuration illustrated in FIG. 21, the merchandise 808 will fall into the product containment area 812 for subsequent removable by the customer.

Figure 22:
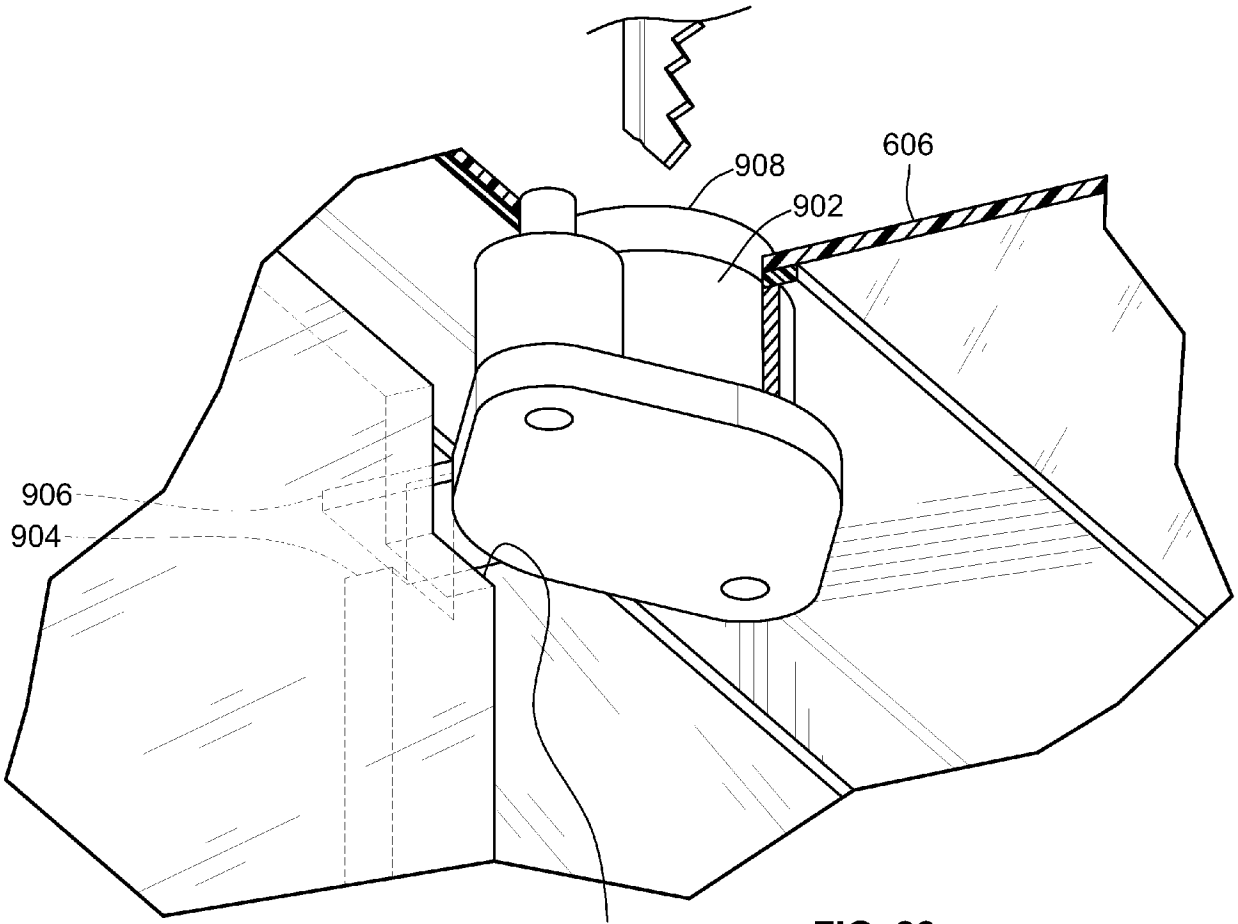
FIG. 22 is a partial perspective view of a lock of the product dispensing system of FIG. 12.

Turning now to FIG. 22, one embodiment of a lock 902 is illustrated for maintaining the slidable front display panels 602 in a locked position during normal operation. More specifically, the lock 902 includes an arm 906 that extends through notches 904 formed in each of the doors 602. The notches 904 are positioned along the doors 602 such that they are generally aligned when each door 602 is at one extreme position of travel relative to the housing 600 (see FIG. 12). With the arm 906 extending through the notches 904, it will be recognized that each door 602 is prevented from sliding in the direction of the other extreme position for each of the doors 602. The lock 902 includes a lock body 908 that extends through the alignment plate 702 (not shown) as well as the top panel 606 to provide key access for locking and unlocking the lock 902.

Figure 23A:
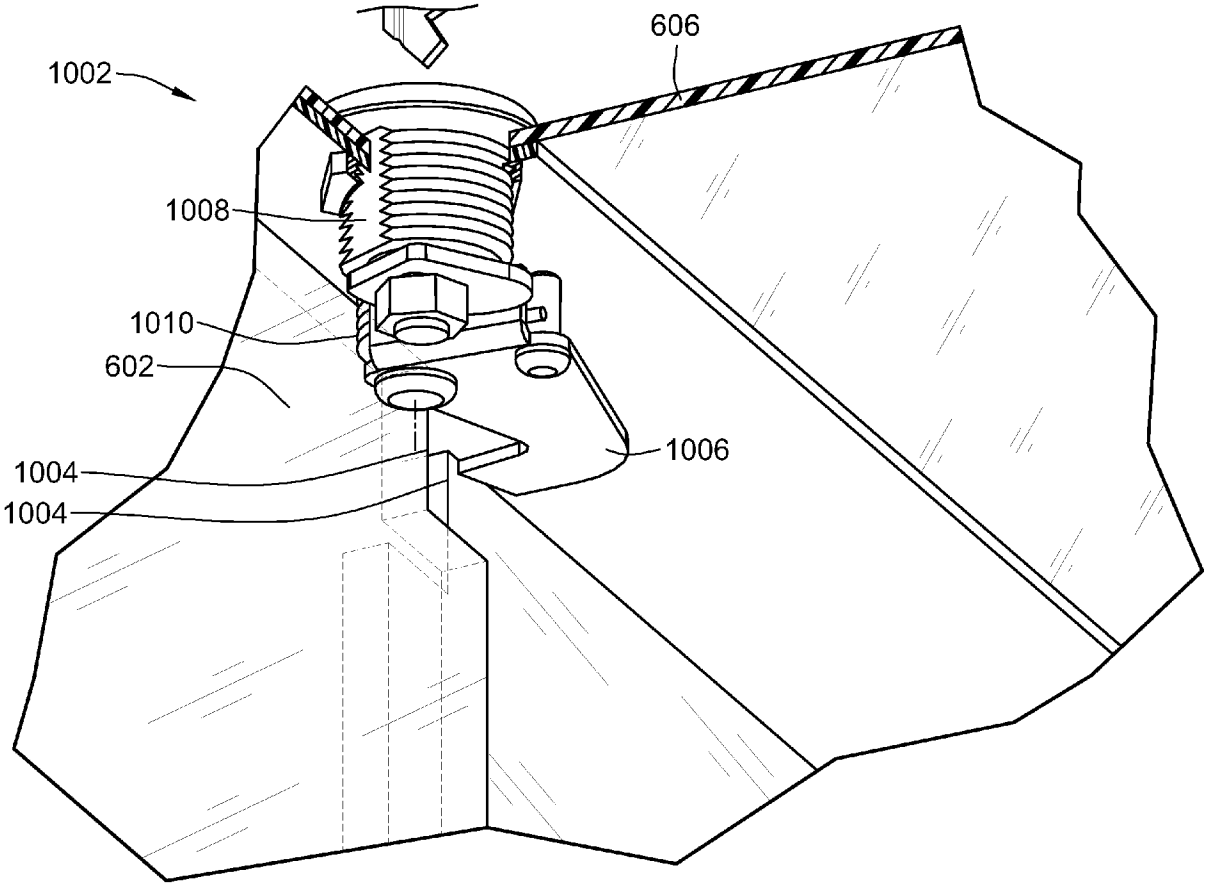
FIGS. 23A and 23B are partial perspective views of another embodiment a lock of the product dispensing system of FIG. 12.
Figure 23B:
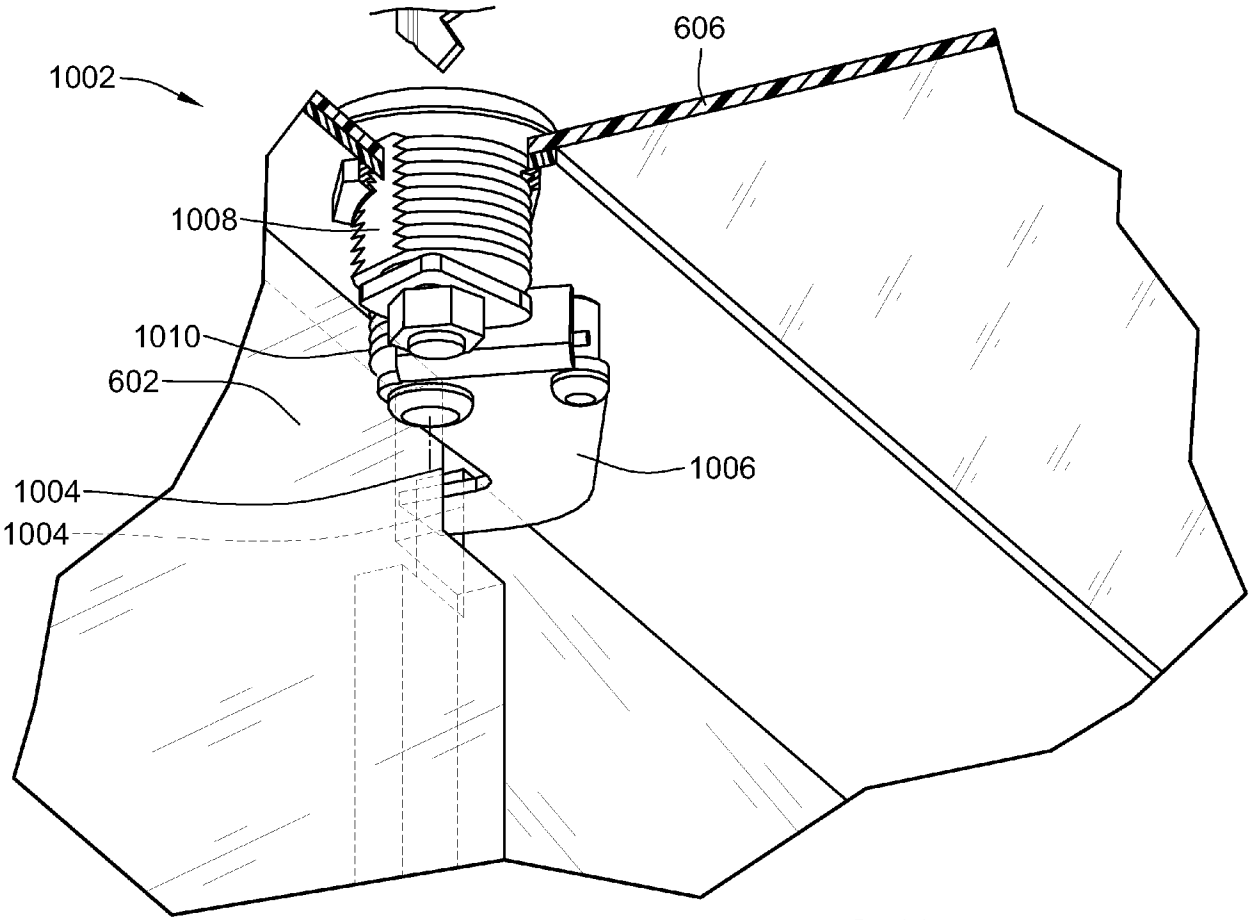

Turning now to FIGS. 23A-23B, another embodiment of a lock 1002 is illustrated. With specific reference to FIG. 23A, the lock 1002 is shown in an unlocked position relative to the doors 602. The lock 1002 includes a lock body 1008 having a cam surface thereon. The cam surface of the lock body 1008 interacts with a lever 1006. The lever 1006 is biased against the cam surface of the lock body 1008 by way of a biasing element 1010. In the illustrated embodiment of FIG. 23A, the lever 1006 is shown out of contact and generally not passing through notches 1004 passing through doors 602. As a result, the doors 602 are freely slideable relative to the lock 1002 to allow for the loading and unloading of merchandise from the product dispensing system 510 (see FIG. 12).

However, when the lock body 1008 rotates by way of a key, the cam surface will interact with the lever 1006 to bias a locking portion of the lever 1006 into the notches 1004 of the doors 602 as is shown in FIG. 23B. When the locking portion of the arm 1006 is positioned within the notches 1004, the doors 602 will not slide relative to the lock 1002. As a result, the product dispensing system 510 (see FIG. 12) is maintained in a lock state such that merchandise may only be retrieved by operating sliders 630*a* and 630*b* and catch tray 610 as described above.

It will be recognized that as the lock 1002 is rotated back to the unlocked position as shown at FIG. 23A, the biasing element 1010 will bias the arm 1006 against the cam surface and out of the notches 1004. As such, the biasing element 1010 advantageously returns the arm 1006 to an unlocked configuration.

Figure 24:
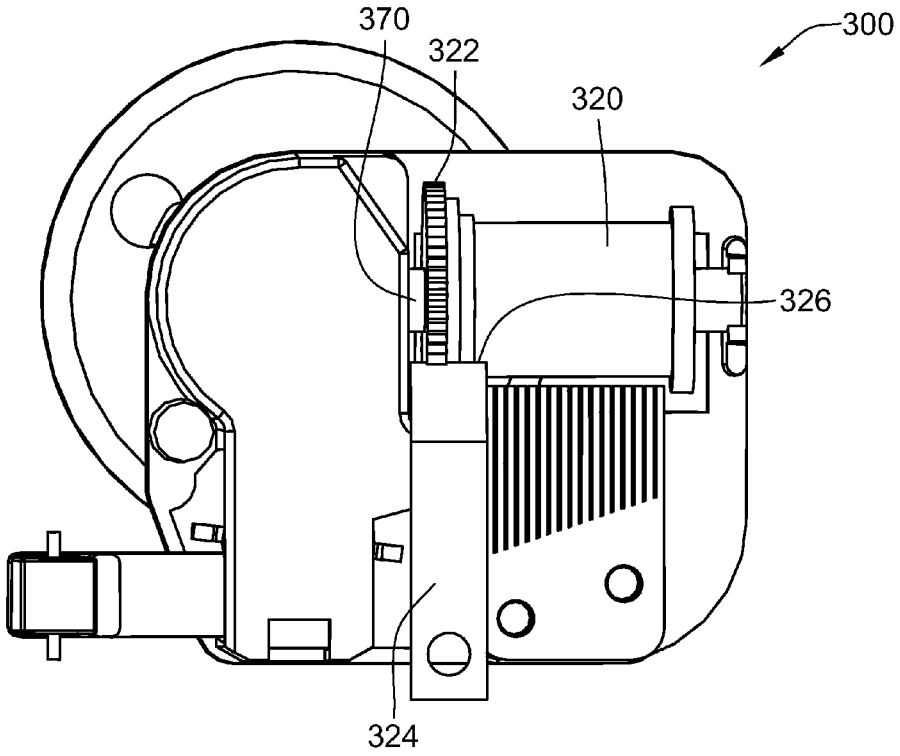
FIG. 24 is another embodiment of the drive assembly of FIGS. 10A-10B and 11.

Turning now to FIG. 24, an alternative embodiment of a drive assembly 300 is illustrated. This embodiment of a drive assembly 300 is essentially the same as the drive assembly 300 described above, with the exception that the same incorporates a mechanism for providing an audible indication of when the drive assembly 300 is in operation (i.e. when product is being biased forward by the drive assembly).

More specifically, the cylinder 320 includes a geared portion 322. The geared portion 322 is in contact with a resilient arm 324. As the cylinder 320 and shaft 370 rotate, the geared portion 322 of the cylinder 320 will contact an end 326 of the arm 324. The end 326 will resiliently snap out of engagement with each tooth of the geared portion 322 as the cylinder 320 rotates. The result of this snapping engagement is an audible clicking noise.

This audible clicking noise signifies the operation of the drive assembly 300, and as such, movement of product from one of the product retainers as described above to the catch tray as described above. This operations advantageously alerts store employees in the presents of the product dispensing system that the same is being utilized to dispense retail merchandise.

It will be recognized from the foregoing that the structural features of the embodiments illustrated in FIGS. 1A-11 may be equally applied or integrated with the structural features and configurations of the embodiment of FIGS. 12-24. Indeed, these embodiments are not mutually exclusive and it will be readily recognized that the advantages and inventive aspects of one embodiment may be readily combined with those of the other.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display for securely carrying retail merchandise in a retail environment, comprising:

a retail support wall adapted for carrying retail merchandise thereon;

a housing mounted to the retail support wall, the housing defining a secure retail storage area;

at least one merchandise retainer mounted within the secure retail storage area for carrying retail merchandise thereon, the merchandise retainer including a biasing mechanism for biasing retail merchandise forward;

a selector coupled to the housing, wherein depression of an actuator of the selector causes the biasing mechanism of the at least one merchandise retainer to bias an item of retail merchandise forward to transition the item of retail merchandise from a secured storage area to an unsecured storage area to allow customer access to the item of retail merchandise; and wherein the housing includes at least one slidable door, and wherein a merchandise channel is formed between the at least one slidable door and the at least one merchandise retainer, the merchandise channel arranged to permit communication between the secured storage area and the unsecured storage area.

2. The retail display of claim 1, wherein the at least one slidable door includes a lock for fixing the position of the at least one slidable door relative to the remainder of the housing such that access to retail merchandise carried by the housing is restricted to the unsecured storage area.

3. The retail display of claim 1, wherein the at least one merchandise channel communicates with a catch tray defining the unsecured storage area, the catch tray positioned below the at least one merchandise retainer.

4. The retail display of claim 3, wherein the catch tray is rotatable between an open position and a closed position such that access to the unsecured storage area is allowed in the open position and prevented in the closed position.

5. The retail display of claim 4, wherein the catch tray includes a shield, the shield positioned adjacent to an opening of the catch tray such that retail merchandise is prevented from entry into the unsecured storage area when the catch tray is in the open position.

6. The retail display of claim 5, wherein the shield is positioned relative to the at least one merchandise retainer such that retail merchandise is biased off of the shield by the at least one merchandise retainer as the catch tray transitions from the open position to the closed position.

7. The retail display of claim 6, wherein the catch tray includes a biasing element for biasing the catch tray from the open position to the closed position.

8. A retail display for securely carrying retail merchandise in a retail environment, comprising:

a retail support wall adapted for carrying retail merchandise thereon;

a housing mounted to the retail support wall, the housing defining a secure retail storage area;

at least one merchandise retainer mounted within the secure retail storage area for carrying retail merchandise thereon, the merchandise retainer including a biasing mechanism for biasing retail merchandise forward;

a selector coupled to the housing, wherein depression of an actuator of the selector causes the biasing mechanism of the at least one merchandise retainer to bias an item of retail merchandise forward to transition the item of retail merchandise from a secured storage area to an unsecured storage area to allow customer access to the item of retail merchandise; and wherein the at least one merchandise retainer includes a plurality of merchandise retainers, and wherein the selector is slidable along a track of the housing, the selector selectively alignable with each one of the plurality of merchandise retainers.

9. The retail display of claim 8, wherein the actuator of the selector is magnetic, and wherein the biasing mechanism of each of the plurality of merchandise retainers includes a lock for preventing actuation of the biasing mechanism, wherein depression of the actuator magnetically unlocks the lock to allow actuation of the biasing mechanism.

10. A retail display for retail merchandise in a display unit, comprising:

a security enclosure for securing retail merchandise therein, the enclosure having an outlet area arranged to facilitate customer access to merchandise;

a retail mount adapted to mount the security enclosure to a retail display unit;

a merchandise retainer contained in the security enclosure, the merchandise retainer adapted to retain retail merchandise in the security enclosure and above the outlet area;

a drive operable to release retail merchandise from the merchandise retainer to the outlet area;

a selector along the security enclosure, the selector operable to actuate the drive to release retail merchandise;

wherein the merchandise retainer includes a first and a second plurality of merchandise retainers, the first plurality arranged in a row and the second plurality arranged in a row below the first plurality, the first plurality of merchandise retainers mounted between a first pair of mounting brackets of the plurality of mounting brackets and the second plurality of merchandise retainers mounted on top of a second pair of mounting brackets of the plurality of mounting brackets; and wherein each one of the first plurality of merchandise retainers includes a front and a rear engagement rib, and wherein each one of the first pair of mounting brackets includes a groove for receiving the front and rear engagement ribs, respectively.

11. The retail display of claim 10, wherein the security enclosure includes a plurality of mounting brackets adapted for receiving the merchandise retainer.

12. The retail display of claim 10, wherein one of the first pair of mounting brackets includes a resilient member for biasing the first plurality of merchandise retainers into engagement with the other one of the pair of mounting brackets.

13. The retail display of claim 10, wherein each one of the second plurality of merchandise retainers includes retaining members formed on a bottom thereof for affixing the second plurality of merchandise retainers to the second pair of mounting brackets in a fixed position.

14. A product dispensing system, comprising:

a display housing having a slot extending along a bottom side thereof;

at least one product retaining rack releasably disposed within the display housing, each product retaining rack configured for releasably retaining a plurality of products longitudinally therealong and including:

a pusher, the pusher engaged within a track defined along the product retaining rack and longitudinally translatable along the product retaining rack to translate the products with respect to the product retaining rack;

a selectively actuatable drive assembly coupled to the pusher such that, when activated, the drive assembly effects longitudinal translation of the pusher with respect to the product retaining rack in a forward direction, thereby translating the plurality of products in a forward direction; and an actuator positioned on the display housing, the actuator selectively positionable adjacent the at least one product retaining rack, the actuator depressible from an un-actuated position to an actuated position wherein the drive assembly is activated to effect longitudinal translation of the pusher with respect to the product retaining rack;

wherein, when the products are translated forward with respect to the product retaining rack a pre-determined distance, one of the products disengages the product retaining rack and exits the display housing through the slot defined therein.

* * * * *